US011793385B2

(12) United States Patent
Pastore et al.

(10) Patent No.: US 11,793,385 B2
(45) Date of Patent: Oct. 24, 2023

(54) VERTICAL SENSING IN AN AUTONOMOUS CLEANING ROBOT

(71) Applicant: iRobot Corporation, Bedford, MA (US)

(72) Inventors: Andrew J. Pastore, Watertown, MA (US); Pu Zhou, Bedford, MA (US); Eric Burbank, Lexington, MA (US)

(73) Assignee: iRobot Corporation, Bedford, MA (US)

( * ) Notice: Subject to any disclaimer, the term of this patent is extended or adjusted under 35 U.S.C. 154(b) by 62 days.

(21) Appl. No.: 17/732,939

(22) Filed: Apr. 29, 2022

(65) Prior Publication Data

US 2022/0280011 A1 Sep. 8, 2022

Related U.S. Application Data

(63) Continuation of application No. 16/588,575, filed on Sep. 30, 2019, now Pat. No. 11,330,953.

(51) Int. Cl.
*A47L 11/40* (2006.01)
*A47L 9/00* (2006.01)

(52) U.S. Cl.
CPC ..... *A47L 11/4061* (2013.01); *A47L 9/009* (2013.01); *A47L 2201/04* (2013.01)

(58) Field of Classification Search
CPC .. A47L 2201/04; A47L 11/4061; A47L 9/009; A47L 9/2805; A47L 9/2852; A47L 9/2889
See application file for complete search history.

(56) References Cited

U.S. PATENT DOCUMENTS 6,883,201 B2 4/2005 Jones et al.
7,603,744 B2 * 10/2009 Reindle ..... G05D 1/0227 15/319
7,647,144 B2 1/2010 Haegermarck
7,992,251 B2 * 8/2011 Chung ..... A47L 9/2857 15/319
8,584,305 B2 11/2013 Won et al.
8,950,792 B2 2/2015 Hickey et al.
9,505,140 B1 11/2016 Fay et al.
(Continued)

FOREIGN PATENT DOCUMENTS

CN 101313829 A 12/2008
CN 101621952 A 1/2010
(Continued)

OTHER PUBLICATIONS

"U.S. Appl. No. 16/588,575, Examiner Interview Summary dated Feb. 4, 2022", 2 pgs.
"U.S. Appl. No. 16/588,575, Non Final Office Action dated Nov. 3, 2021", 19 pgs.
"U.S. Appl. No. 16/588,575, Notice of Allowance dated Mar. 31, 2022", 15 pgs.
"U.S. Appl. No. 16/588,575, Response filed Feb. 2, 2022 to Non Final Office Action dated Nov. 3, 2021", 13 pgs.
(Continued)

*Primary Examiner* — Marc Carlson
(74) *Attorney, Agent, or Firm* — Schwegman Lundberg & Woessner, P.A.

(57) ABSTRACT

An autonomous mobile cleaning robot can include an outer shell and a bumper. The outer shell can include a rim extending around at least a portion of a periphery of the outer shell and can include a first feature connected to the rim. The bumper can be connected to the outer shell and can movable with respect to the outer shell when the bumper is connected to the outer shell. The bumper can include a second feature connected to the inner surface.

20 Claims, 17 Drawing Sheets

(56) References Cited

U.S. PATENT DOCUMENTS

| | | | | |
|---|---|---|---|---|
| 10,874,275 | B2 * | 12/2020 | Liggett | A47L 9/2805 |
| 11,330,953 | B2 | 5/2022 | Pastore et al. | |
| 2005/0021181 | A1 * | 1/2005 | Kim | G05D 1/0227 318/568.12 |
| 2005/0217061 | A1 | 10/2005 | Reindle | |
| 2008/0300720 | A1 * | 12/2008 | Kim | A47L 9/2852 901/1 |
| 2010/0133022 | A1 * | 6/2010 | Chung | A47L 9/2884 180/21 |
| 2016/0051104 | A1 * | 2/2016 | Shin | A47L 9/2852 180/218 |
| 2017/0072570 | A1 * | 3/2017 | Fay | G01D 5/142 |
| 2017/0156560 | A1 * | 6/2017 | Jung | A47L 9/2884 |
| 2018/0078106 | A1 * | 3/2018 | Scholten | G01S 17/931 |
| 2019/0069744 | A1 * | 3/2019 | Liggett | A47L 9/2805 |
| 2019/0193499 | A1 * | 6/2019 | Wei | B60G 3/14 |
| 2021/0093146 | A1 * | 4/2021 | Pastore | A47L 11/4061 |

FOREIGN PATENT DOCUMENTS

| | | | |
|---|---|---|---|
| CN | 104350441 | A | 2/2015 |
| CN | 204146964 | U | 2/2015 |
| CN | 214433995 | U | 10/2021 |
| JP | 2005211494 | | 8/2005 |
| JP | 2008284050 | | 11/2008 |

OTHER PUBLICATIONS

"Chinese Application Serial No. 202011037719.4, Office Action dated Sep. 1, 2021", w/ English Translation, 17 pgs.

"Chinese Application Serial No. 202011037719.4, Response filed Jan. 9, 2022 to Office Action dated Sep. 1, 2021", w/o English Claims, 40 pgs.

"Chinese Application Serial No. 202022173945.7, Response filed Sep. 8, 2021 to Notification to Make Rectification dated Jun. 24, 2021", w/ English Claims, 58 pgs.

"Chinese Application Serial No. 202022174012.X, Response filed Sep. 9, 2021 to Notification to Make Rectification dated Jun. 24, 2021", w/ English Claims, 57 pgs.

"International Application Serial No. PCT/US2020/052137, International Search Report dated Dec. 15, 2020", 2 pgs.

"International Application Serial No. PCT/US2020/052137, Written Opinion dated Dec. 15, 2020", 5 pgs.

"Shark ION Robot & Handheld Cleaning System RV850WV Series", SharkClean.com, (2019), 19 pgs.

"International Application Serial No. PCT US2020 052137, International Preliminary Report on Patentability dated Apr. 14, 2022", 7 pgs.

"Japanese Application Serial No. 2022-508560, Notification of Reasons for Refusal dated Feb. 28, 2023", w English Translation, 6 pgs.

* cited by examiner

VERTICAL SENSING IN AN AUTONOMOUS CLEANING ROBOT

PRIORITY APPLICATIONS

This application is a continuation of U.S. patent application Ser. No. 16/588,575, filed Sep. 30, 2019, the content of which is incorporated herein by reference in its entirety.

BACKGROUND

Autonomous mobile robots include autonomous cleaning robots that can autonomously perform cleaning tasks within an environment, such as a home. Many kinds of cleaning robots are autonomous to some degree and in different ways. The autonomy of mobile cleaning robots can be enabled by the use of a sensors receiving inputs from, or caused by the robot's interaction with, the environment, where the sensors transmit signals to a controller. The controller can control operation of the robot based on analysis performed on one or more sensor signals.

SUMMARY

The controller can control operation(s) of the robot based on analysis performed on one or more of the sensor signals. In some examples, autonomous cleaning robots can use bump sensors, which can be attached to a body of the robot and can be configured to detect when an outer bumper of the robot engages or bumps into an object. In such an instance, the object can engage the bumper to move the bumper with respect to the body of the robot, allowing the bumper to engage a switch. The switch can send a signal to the controller to indicate a bump, allowing the robot to change speed and/or direction to avoid future bumps of the same object. Simple switch sensors can be used, in part, because they are relatively inexpensive, which can help lower manufacturing costs of the robot. Many inexpensive switches move along a single axis allowing for movement detection along that axis. Because horizontal bumps are common, the switch can be oriented such that contact by the bumper with the switch in a horizontal direction actuates the switch to indicate a bump. In some examples, multiple switches can be used to detect movement of the bumper anywhere along a vertical plane.

It may also be desired to also detect bumps along a vertical axis. Vertical bump sensing can be important to help prevent wedging of autonomous cleaning robots (such as under furniture) during a mission. However, the horizontally aligned switches cannot detect vertical forces applied to the bumper (vertical bumps), which means different and/or additional sensors can be required to sense vertical bumps, which can increase cost and complexity of the control system.

This disclosure can help address such problems, such as by providing a bumper and an outer shell that include components that work together to translate vertical forces applied to the bumper to horizontal movement of the bumper with respect to an outer shell of the robot, enabling the bumper to actuate the horizontally, actuated switches in response to vertical bumps. These designs can help reduce cost of the robot.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A controller of an autonomous cleaning robot can control operation of the robot based on analysis performed on one or more sensor signals delivered to the controller by sensors of the robot. In some examples, autonomous cleaning robots can use bump sensors. Bump sensors can be attached to a body of the robot and can be configured to detect when an outer bumper of the robot engages or bumps into an object. In such an instance, the object can engage the bumper to move the bumper with respect to the body of the robot, allowing the bumper to engage a switch. The switch can send a signal to the controller to indicate a bump, allowing the robot to change speed and/or direction to avoid future bumps of the same object.

Simple switch sensors can be used, in part, because they are relatively inexpensive, which can help lower manufacturing costs of the robot. Most (inexpensive) switches move along a single axis allowing for movement detection along that axis. Because horizontal bumps are very common, the switch can be oriented such that contact by the bumper on the switch in a horizontal direction actuates the switch to indicate a bump. Multiple switches can be used to detect movement of the bumper anywhere along a vertical plane.

It may also be desired to also detect bumps along a vertical axis. Vertical bump sensing can be important to help prevent wedging of autonomous cleaning robots (such as under furniture) during a mission. However, the horizontally aligned switches cannot detect vertical forces applied to the bumper (vertical bumps), which means different and/or additional sensors can be required to sense vertical bumps, which can increase cost and complexity of the control system.

This disclosure can help address such problems, such as by providing a bumper and an outer shell that include components that work together to translate vertical forces applied to the bumper to horizontal movement of the bumper with respect to an outer shell of the robot, enabling the bumper to actuate the horizontally actuated switches in response to vertical bumps. These designs can help reduce cost of the robot.

The above discussion is intended to provide an overview of subject matter of the present patent application. It is not intended to provide an exclusive or exhaustive explanation of the invention. The description below is included to provide further information about the present patent application.

Figure 1A:
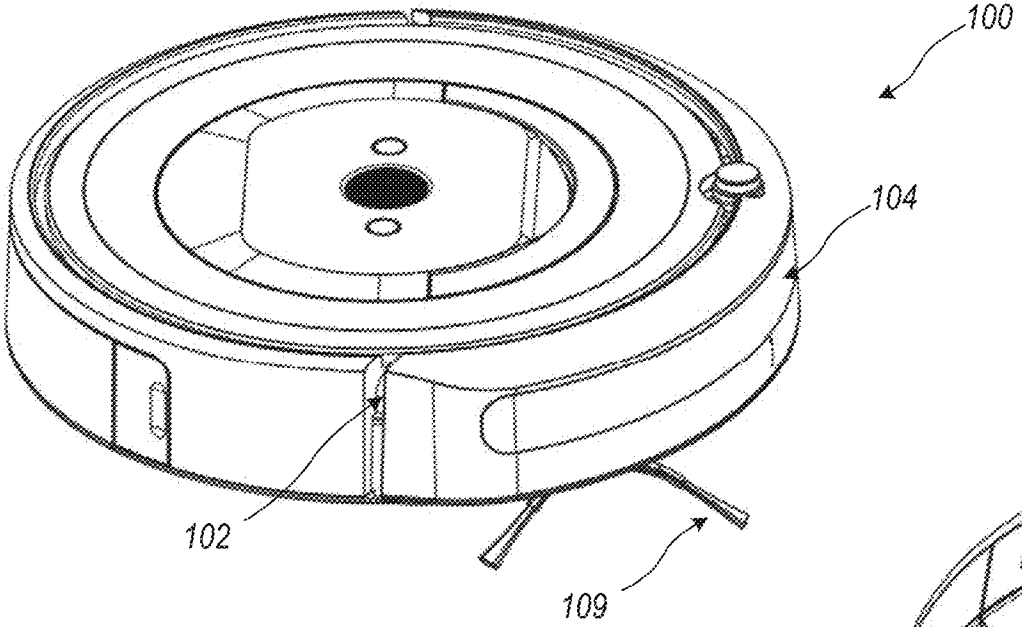
FIG. 1A illustrates a top isometric view of an autonomous cleaning robot, in accordance with at least one example of this disclosure.
Figure 1B:
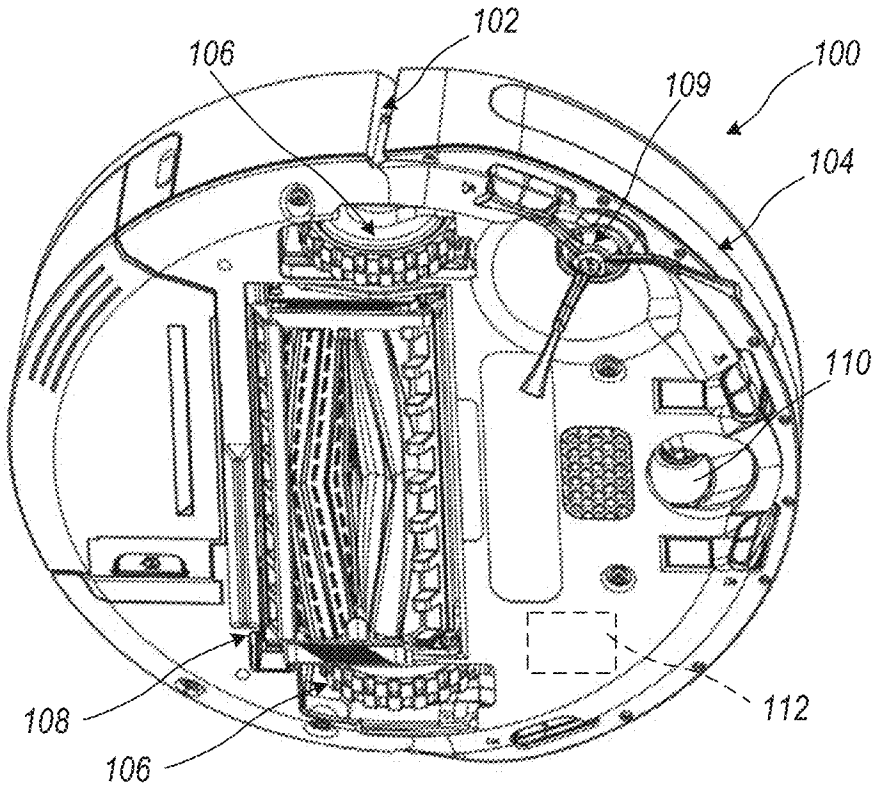
FIG. 1B illustrates a bottom isometric view of an autonomous cleaning robot, in accordance with at least one example of this disclosure.
Figure 2:
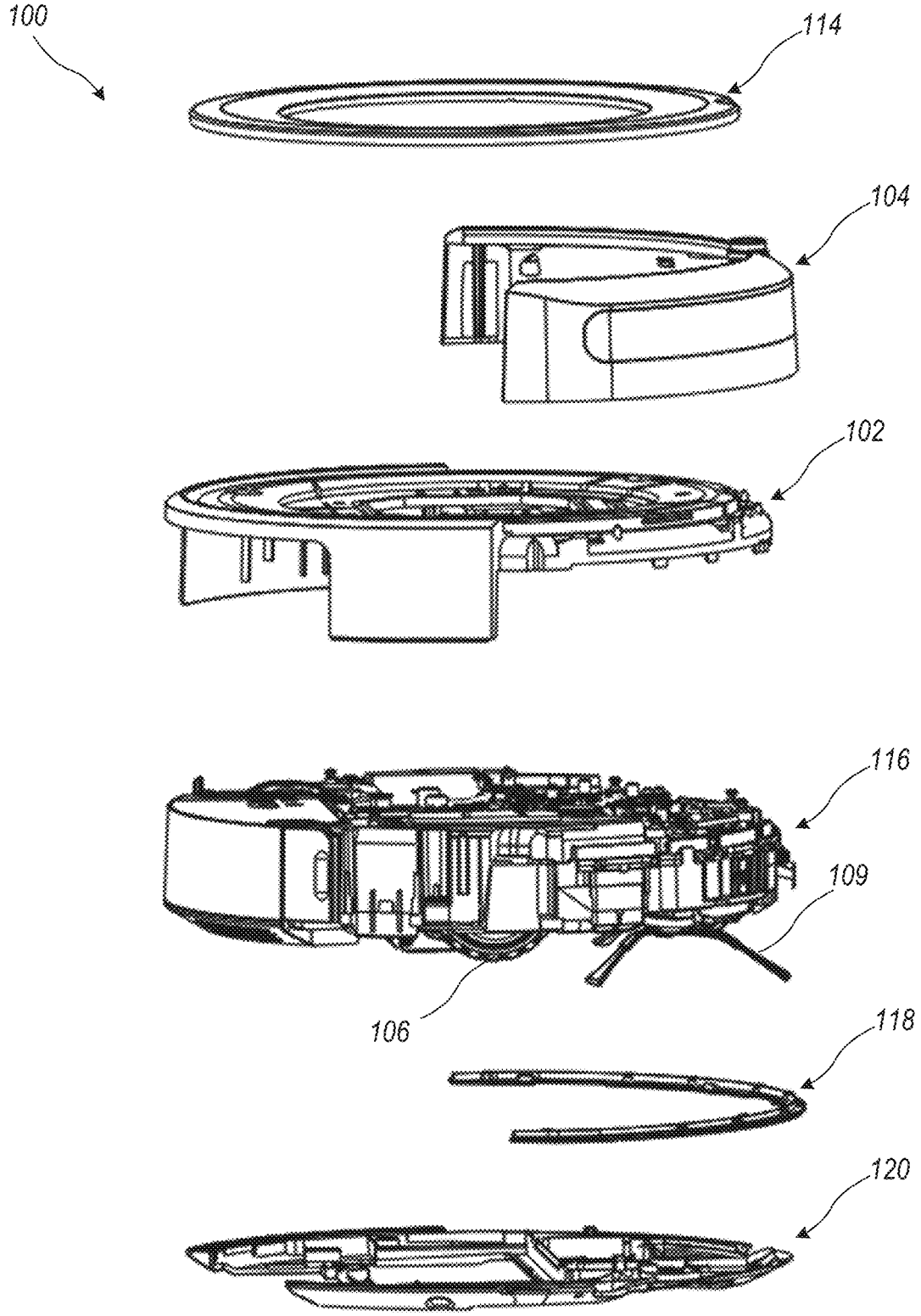
FIG. 2 illustrates an exploded isometric view of an autonomous cleaning robot, in accordance with at least one example of this disclosure.

FIG. 1A illustrates a top isometric view of an autonomous cleaning robot 100, in accordance with at least one example of this disclosure. FIG. 1B illustrates a bottom isometric view of an autonomous cleaning robot IOU, in accordance with at least one example of this disclosure. FIG. 2 illustrates an exploded isometric view of the autonomous cleaning robot 100, in accordance with at least one example of this disclosure. FIGS. 1A, 1B, and 2 are discussed below concurrently.

The autonomous cleaning robot 100 can include an outer shell 102, a bumper 104, drive wheels 106, an extractor assembly 108, a side brush 109. a nose wheel 110, and a controller 112. As shown in FIG. 2, the robot 100 can also include a top cover 114, a body 116, a bottom retainer 118, and a bottom cover 120.

The outer shell 102 can be a rigid or semi-rigid member secured to the body 116 of the robot and configured to support the bumper 104 thereon. The bumper 104 can be removably secured to the outer shell 102 and can be movable relative to the outer shell 102 while mounted thereto. The outer shell 102 and the bumper 104 can each be comprised of materials such as one or more of metals, plastics, foams, elastomers, ceramics, composites, combinations thereof, or the like.

The drive wheels 106 can be supported by the body 116 of the robot 102. The wheels 106 can be connected to and rotatable with a shaft; the wheels 106 can be configured to be driven by a motor to propel the robot 100 along a surface of an environment, where the motor is in communication with the controller 112 to control such movement of the robot 100 in the environment. The nose wheel 110 can be connected to the body 116 of the robot and can be either a passive or driven wheel configured to balance and steer the robot 102 within the environment.

The extractor assembly 108 can include one or more rollers or brushes rotatable with respect to the body 116 to collect dirt and debris from the environment. The rollers can be powered by one or more motors in communication with the controller 112. The side brush 109 can be connected to an underside of the robot 100 and can be connected to a motor operable to rotate the side brush 109 with respect to the body 116 of the robot. The side brush 109 can be configured to engage debris to move the debris toward the extractor assembly 108 and/or away from edges. The motor configured to drive the side brush 109 can be in communication with the controller 112.

The controller 112 can be a programmable controller, such as a single or multi-board computer, a direct digital controller (DDC), a programmable logic controller (PLC), or the like. In other examples the controller 112 can be any computing device, such as a handheld computer, for example, a smart phone, a tablet, a laptop, a desktop computer, or any other computing device including a processor, memory, and communication capabilities.

The top cover 114 can be secured to the outer shell 102 and/or the body 116 to generally protect the components within the robot 100. The body 116 can be a rigid or semi-rigid structure comprised of materials such as one or more of metals, plastics, foams, elastomers, ceramics, composites, combinations thereof, or the like. The body 116 can be configured to support various components of the robot 100, such as the wheels 106, the controller 112, a battery, the extractor assembly 108, and the side brush 109. The bottom retainer 118 can be secured to the body 116 of the robot 100 and can help secure the bottom cover 120 to the body 116. The bottom cover 120 can be configured to cover and generally protect various components within the robot 100 from impact and debris.

In operation of some examples, the robot 100 can be controlled by the controller 112, autonomously, to perform a cleaning mission within the environment. The controller 112 can control operation of the drive wheels 106 and the nose wheel 110 to move the robot 100 throughout the environment. The controller 112 can also control operation of the extractor assembly 108 (and a pump within the robot 100) to intake debris from the environment during the mission while the side brush 109 can be operated by the controller 112 to direct debris toward the extractor assembly 108.

During operation, the bumper 104 can be contacted by objects within the environment, which can cause movement of the bumper 104 with respect to the outer shell 102. When the bumper 104 is bumped by one or more objects, it can engage a switch or switches mounted to the body or the outer shell 102 of the robot 100. The switches can each be a push-button switch, rocker switch, toggle switch, or the like. When pressed by the bumper 104, a switch can send a signal to the controller 112. The controller can receive and analyze the signal to determine that the bumper 104 has encountered an object (that is, that the bumper 104 has been bumped). When a bump is detected, the controller 112 can operate the drive wheels 106 to change a direction of travel of the robot 100 to avoid the object causing the bump. Once the bumper 104 is released, a biasing element engaged with the bumper 104 and the body 116 can cause the bumper 104 to return to a neutral position where the bumper 104 is positioned to sense a bump caused by the next object the bumper 104 encounters. Such a process can be repeated for each object bump of the bumper 104.

It may be desired to also detect bumps along a vertical axis (or outside the horizontal plane). As discussed above, vertical bump sensing can be important to help prevent wedging of the robot 100 under items, such as furniture, during a cleaning mission. Switches commonly used to detect horizontal bumps are often horizontally aligned switches that often cannot detect vertical bumps, which means different or additional sensors can be required to sense vertical bumps. The addition of such sensors can increase manufacturing cost and can increase complexity of the control system. However, as discussed in further detail below, the robot 100 can include features to allow the bumper 104 to translate horizontally in response to a vertical force, allowing the simple horizontal force switches to detect a vertical bump, helping to avoid the use of additional or more complex sensors, which can help save manufacturing cost.

Figure 3B:
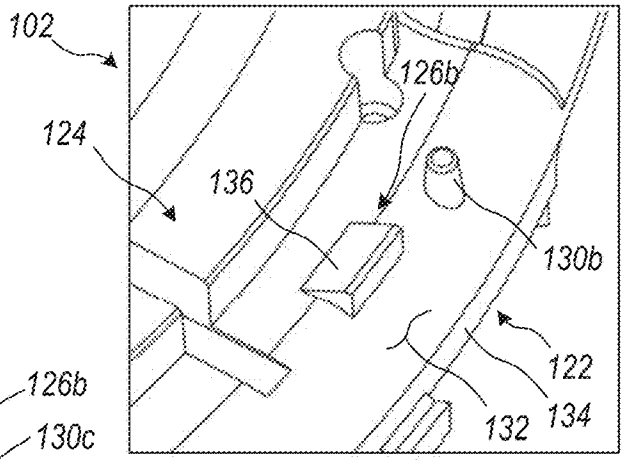
FIG. 3B illustrates a focused top isometric view of a portion of an autonomous cleaning robot, in accordance with at least one example of this disclosure.
Figure 3C:
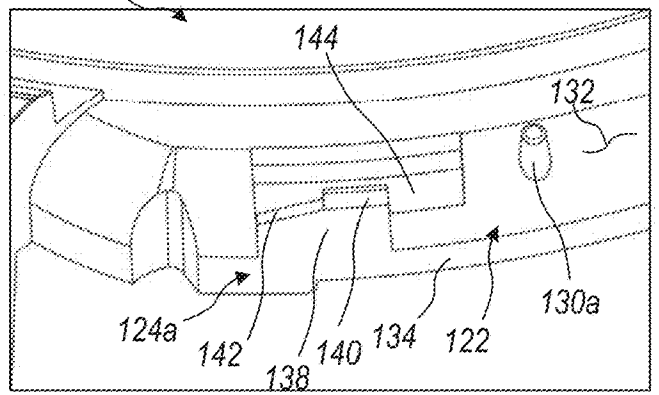
FIG. 3C illustrates a focused top isometric view of a portion of an autonomous cleaning robot, in accordance with at least one example of this disclosure.
Figure 3A:
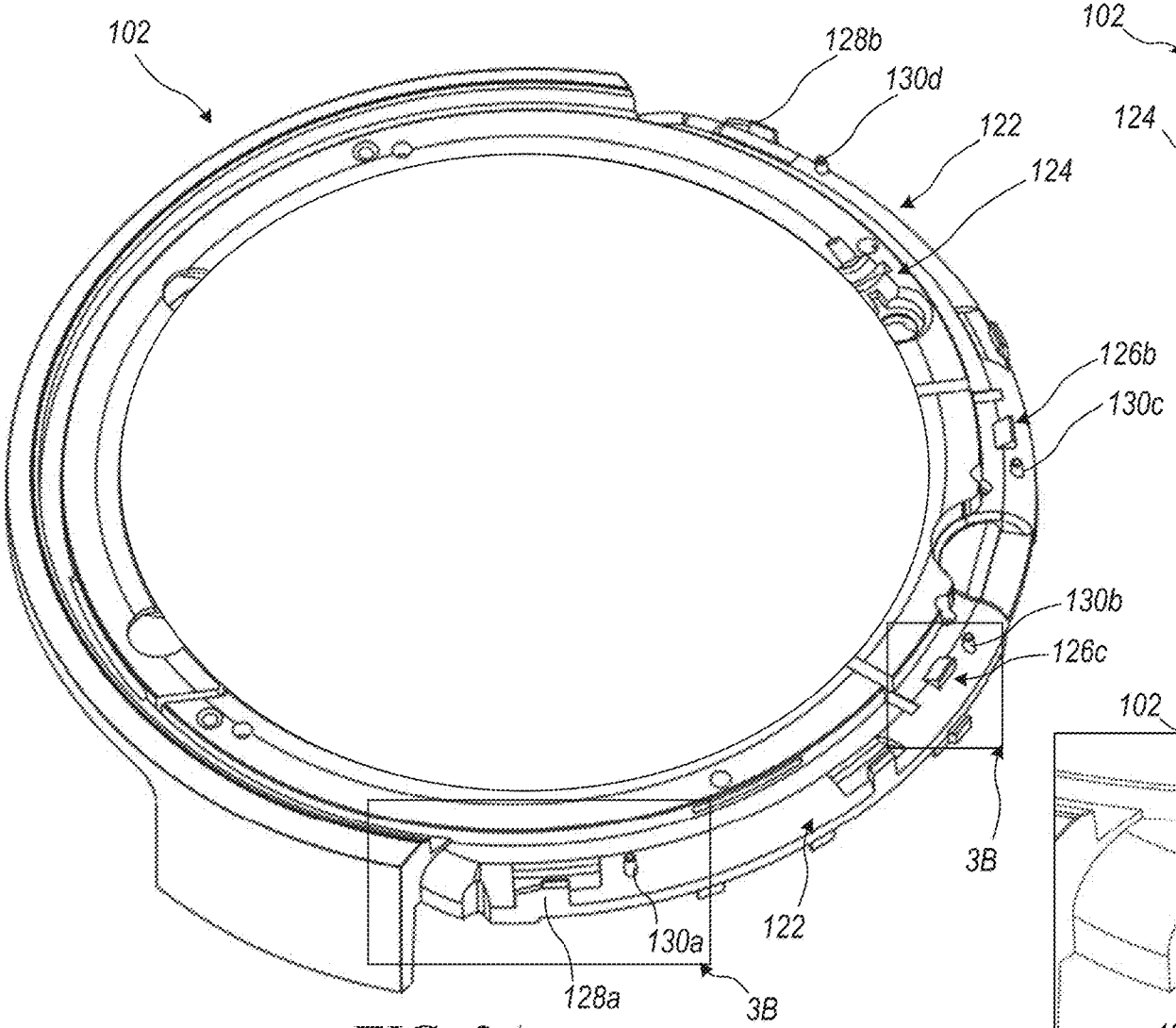
FIG. 3A illustrates a top isometric view of a portion of an autonomous cleaning robot, in accordance with at least one example of this disclosure.

FIG. 3A illustrates a top isometric view of the outer shell 102 of the autonomous cleaning robot 100, in accordance with at least one example of this disclosure. FIG. 3B illustrates a focused top isometric view of the outer shell 102 of the autonomous cleaning robot 100, in accordance with at least one example of this disclosure. FIG. 3C illustrates a focused top isometric view of the outer shell 102 of the autonomous cleaning robot 100, in accordance with at least one example of this disclosure. FIGS. 3A, 3B, and 3C show a first feature, or ramps, that help translate vertical forces applied to the bumper 104 into horizontal movement of the bumper 104 with respect to the outer shell 102. FIGS. 3A-3C are discussed below concurrently.

The outer shell 102 of FIGS. 3A-3C can be consistent with the robot discussed above with respect to FIGS. 1A-2, FIGS. 3A-3C show additional details of the outer shell 102, For example, the outer shell 102 can include an outer lip or rim 122, inner ramps 126*a* and 126*b* (collectively referred to as inner ramps 126), outer ramps 128*a* and 128*b* (collectively referred to as outer ramps 128), and posts 130*a*-130*d*.

As shown in FIGS. 3B and 3C, the outer lip 122 can extend radially outward from a central portion 124 of the outer shell 102 to define a sloped surface 132 and an outer edge 134. As shown in FIG. 3B, the inner ramp 126*b* can extend upward from the outer lip 122 to define a ramp surface 136 sloped downward and radially inward (or substantially radially inward).

As shown in FIG. 3C, the outer ramps 128*a* and 128*b* can extend upwards from the outer lip 122 to define a wall 138 substantially aligned with the outer rim 134. The ramp 124*a* can further define a top pad 140 and a ramp surface 142 sloped downward from the top pad 140 and substantially tangential to the outer lip 122. The ramp 140 can partially define a recess 144 in the outer lip 122. Each of the ramps 126 and 128 can be integrally molded into the outer shell 102 (such as the outer lip 122 in some examples and can be connected to or removably attached to the outer shell in some examples, such as for replacement of the ramps 126 and 128.

The inner ramps 126 and the outer ramps 128 can each be features configured to engage complimentary features of the bumper 104 to cause the bumper 104 to move in a horizontal direction with respect to the outer shell 102 in response to a vertical force applied to the bumper 104.

FIG. 3B also shows that the post 130*b* can have a shape that is a substantially truncated cone. The post 130*b* can extend substantially upward from the sloped surface of the outer lip 122. Similarly, FIG. 3C shows that the post 130*a* can have a shape that is a substantially truncated cone and can extend substantially upward from the sloped surface of the outer lip 122, The posts 130 can each be configured to engage features of the bumper 104 to help retain the bumper 104 on the outer shell 102.

Figure 4B:
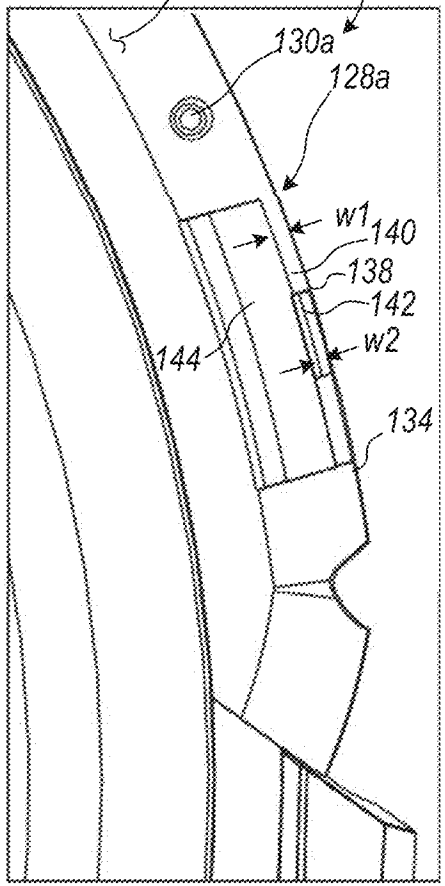
FIG. 4B illustrates a focused top view of a portion of an autonomous cleaning robot, in accordance with at least one example of this disclosure.
Figure 4A:
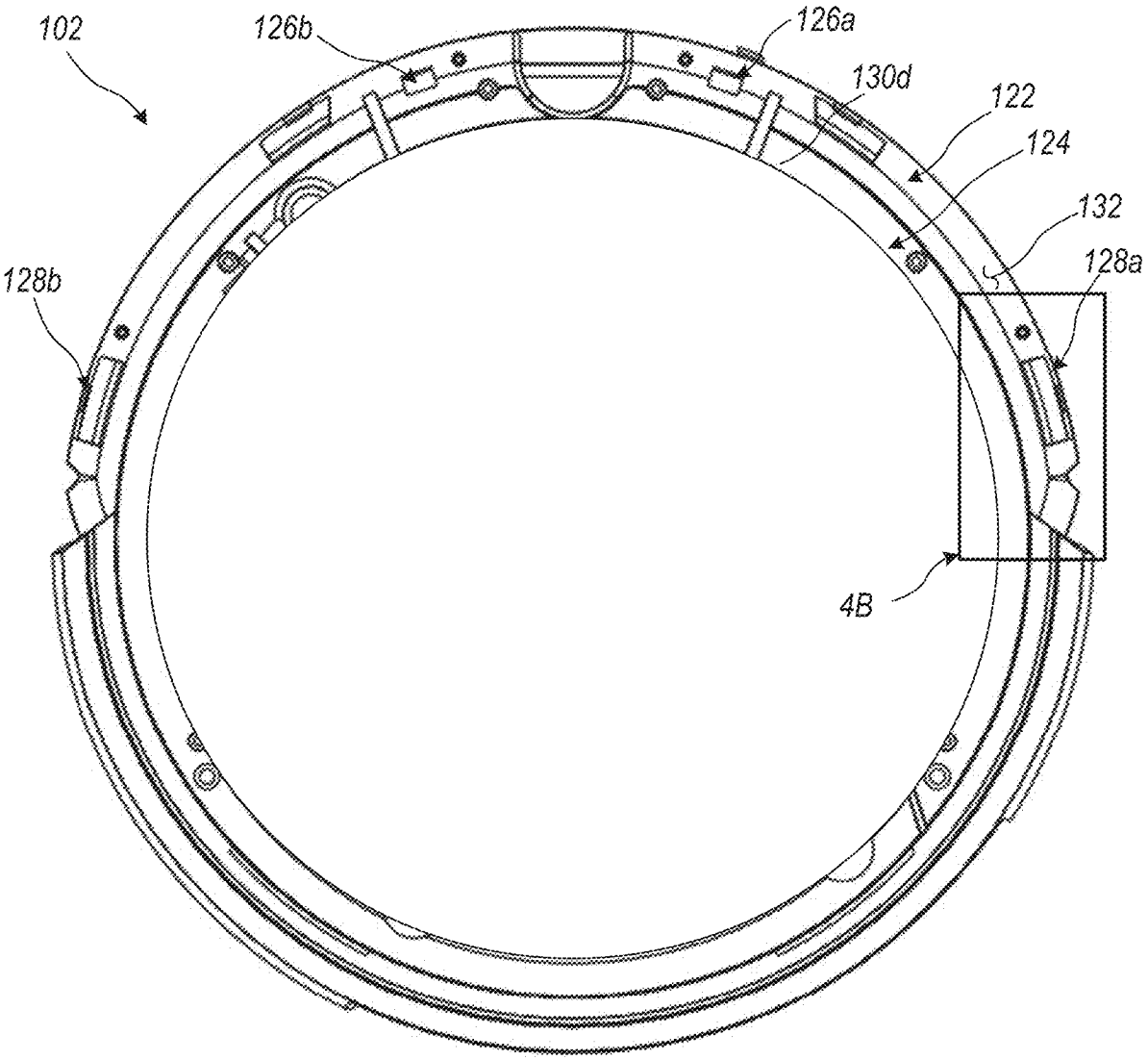
FIG. 4A illustrates a top view of a portion of an autonomous cleaning robot, in accordance with at least one example of this disclosure.

FIG. 4A illustrates a top view of the outer shell 102 of the autonomous cleaning robot 100, in accordance with at least one example of this disclosure. FIG. 4B illustrates a focused top view of the outer shell 102 of the autonomous cleaning robot 100, in accordance with at least one example of this disclosure. FIGS. 4A and 4B are discussed below concurrently. Orientation indicators Front and Rear are shown in FIG. 4A.

The outer shell 102 shown in FIGS. 4A and 4B can be consistent with the outer shell 102 discussed above with respect to FIGS. 1A-3C; further details are discussed below with respect to FIGS. 4A-4B. For example; FIG. 4A shows that the inner ramps 126 can be positioned on a front portion of the outer lip 122 and the outer ramps 128 can be positioned on sides of the outer lip 122 (between the front and rear portions of the outer shell), FIG. 4B also shows that a width of the outer ramps 128 can be relatively small with respect to a width of the outer lip 122. In some examples, a width w2 of the top pad 140 can be larger than a width WI of the ramp surface 142.

Figure 5A:
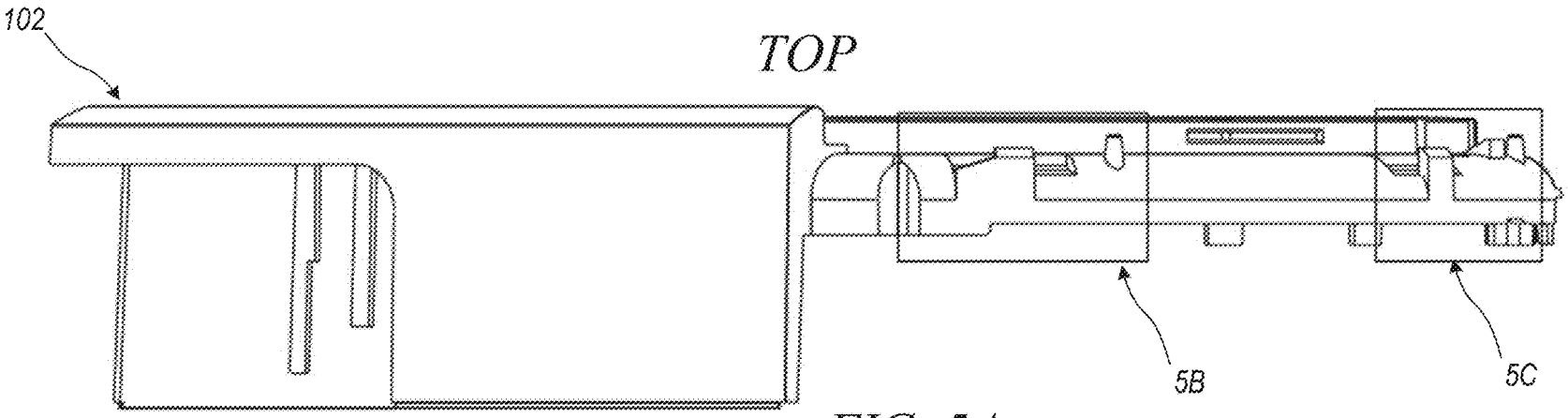
FIG. 5A illustrates a side isometric view of a portion of an autonomous cleaning robot, in accordance with at least one example of this disclosure.
Figure 5C:
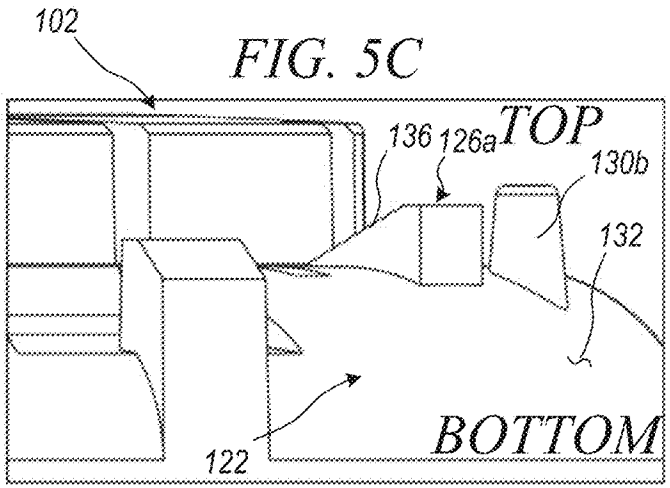
FIG. 5C illustrates a focused side isometric view of a portion of an autonomous cleaning robot, in accordance with at least one example of this disclosure.
Figure 5B:
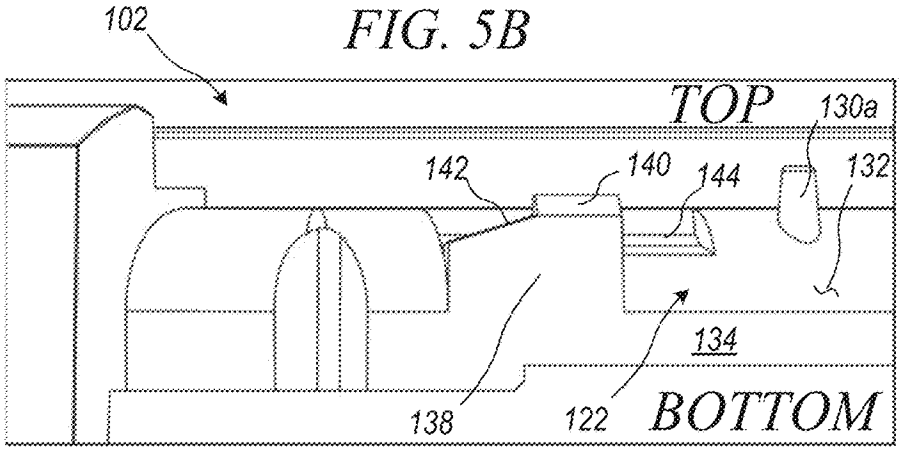
FIG. 5B illustrates a focused side isometric view of a portion of an autonomous cleaning robot, in accordance with at least one example of this disclosure.

FIG. 5A illustrates a side isometric view of the outer shell 102 of the autonomous cleaning robot 100, in accordance with at least one example of this disclosure. FIG. 5B illustrates a focused side isometric view of the outer shell 102 of the autonomous cleaning robot 100, in accordance with at least one example of this disclosure. FIG. 5C illustrates a focused side isometric view of the outer shell 102 of the autonomous cleaning robot 100, in accordance with at least one example of this disclosure. FIGS. 5A-5C are discussed below concurrently. FIGS. 5A-5C show orientation indicators Top and Bottom.

The outer shell 102 of FIGS. 5A-5C can be consistent with the outer shell 102 discussed above with respect to FIGS. 1A-4C, further details are discussed below with respect to FIGS. 5A-5C. For example, FIG. 5B shows how the ramp surface 142 of the outer ramp 128 can be sloped downward and tangentially (or substantially tangentially) to outer lip 134, In some examples, the inner ramps 126 and the outer ramps 136 can be substantially aligned (can face substantially the same direction) to coerce the bumper 104 to move horizontally in a single direction, which can help ensure the bumper switches are activated due to bumps from multiple angles and positions. Also, FIG. 5C shows how the ramp surface 136 of the inner ramp 126*a* can be sloped downward and radially inward Or substantially radially inward). FIG. 5C also shows that the sloped surface 132 of the outer lip 122 can be curved.

Figure 6A:
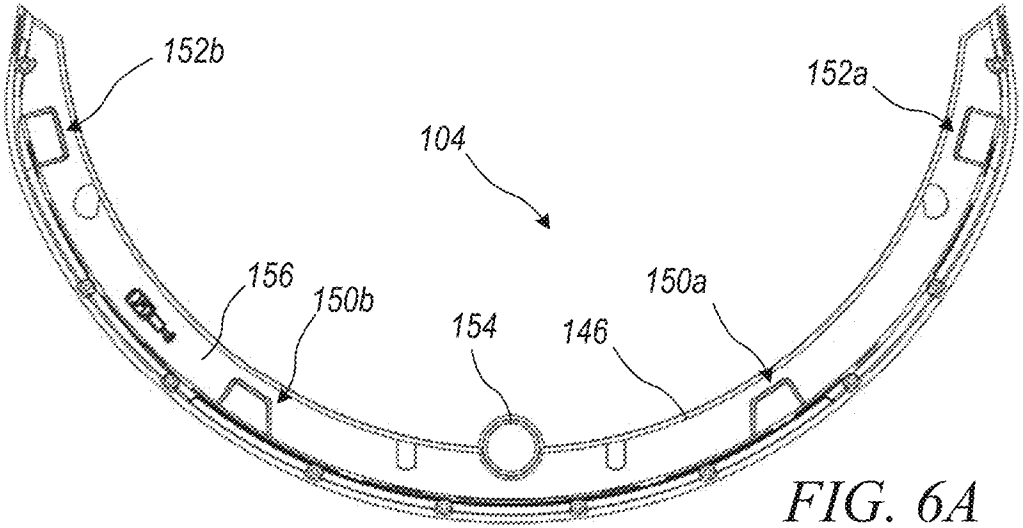
FIG. 6A illustrates a bottom isometric view of a portion of an autonomous cleaning robot, in accordance with at least one example of this disclosure.
Figure 6C:
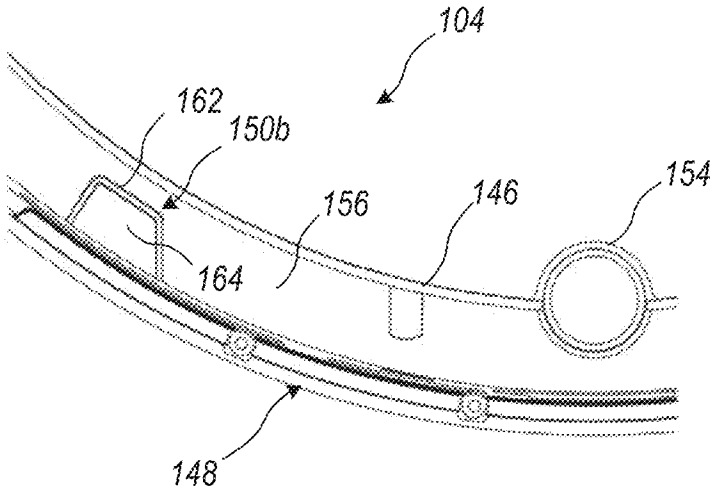
FIG. 6C illustrates a focused bottom isometric view of a portion of an autonomous cleaning robot, in accordance with at least one example of this disclosure.
Figure 6B:
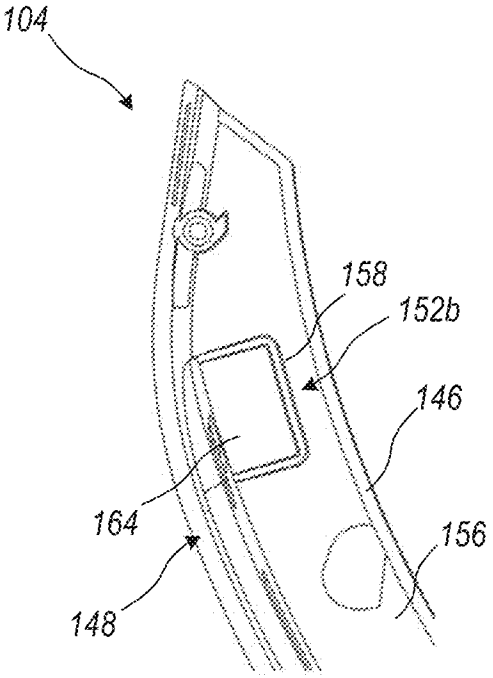
FIG. 6B illustrates a focused bottom isometric view of a portion of an autonomous cleaning robot, in accordance with at least one example of this disclosure.

FIG. 6A illustrates a bottom isometric view of the bumper 104 of the autonomous cleaning robot 100, in accordance with at least one example of this disclosure. FIG. 6B illustrates a focused bottom isometric view of the bumper 104 of the autonomous cleaning robot 100, in accordance with at least one example of this disclosure. FIG. 6C illustrates a focused bottom isometric view of the bumper 104 of the autonomous cleaning robot 100, in accordance with at least one example of this disclosure. FIGS. 6A-6C are discussed below concurrently.

The bumper 104 of FIGS. 6A-6C can be consistent with the bumper 104 discussed above with respect to FIGS. 1A-5C, further details are discussed below with respect to FIGS. 6A-6C. For example, FIG. 6A shows that the bumper 104 can include an inner wall 146, an outer wall 148, inner hoops 150*a* and 150*b*, outer hoops 152*a* and 152*b*, and a sensor housing 154.

The inner wall 146 can be a wall of relatively small thickness and can extend downward from a top portion 156 of the bumper 104. The outer wall 148 can also have a relatively small thickness and can extend downward from the top portion 156 of the bumper 104, but can extend downward further than the inner wall 146 such as to cover and protect a front portion of the robot 102 from debris and impact with objects.

As shown in FIG. 6B, the outer hoop 152*a* can include a hoop wall 158 defining a cavity 160, where the cavity 160 is configured to receive the pin 130*a* therein and is configured to retain the pin 130*a* therein when the bumper 104 is mounted to the outer shell 102. Similarly, as shown in FIG. 6C, the inner hoop 150*b* can include a hoop wall 162 defining a cavity 164, where the cavity 164 is configured to receive and retain the pin 130*b* therein when the bumper 104 is mounted to the outer shell 102. Together, the hoops 150 and 152 can retain the pins 130 while allowing the bumper 104 to move with respect to the pins 130 and therefore the outer shell 102 (and the body 116). Also, as discussed below, the outer hoops 152 can engage the outer ramps 128, respectively, to translate vertical forces applied to the bumper 104 to horizontal movement of the bumper 104.

Figure 7B:
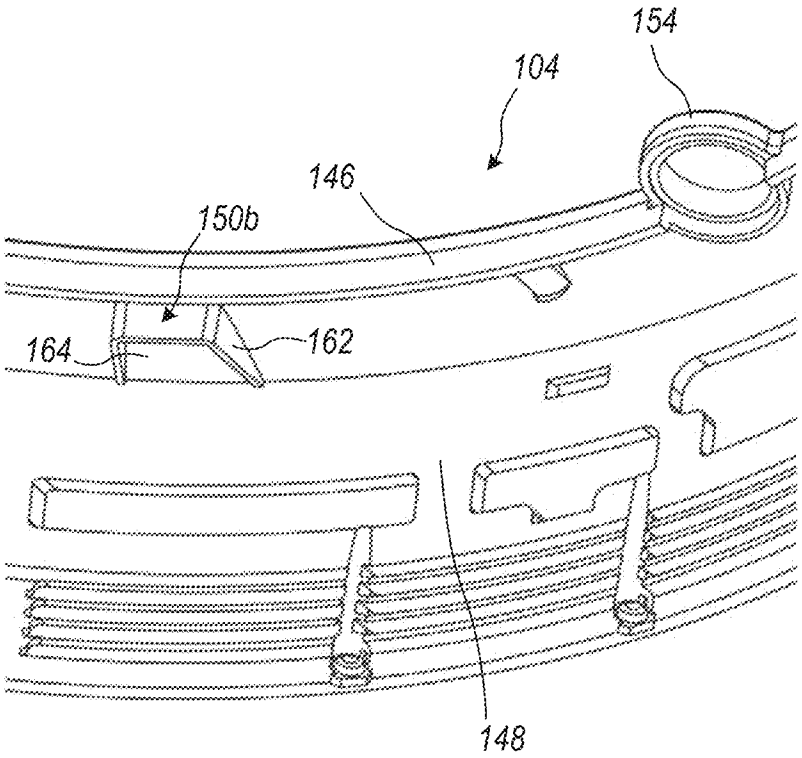
FIG. 7B illustrates a bottom isometric view of a portion of an autonomous cleaning robot, in accordance with at least one example of this disclosure.
Figure 7A:
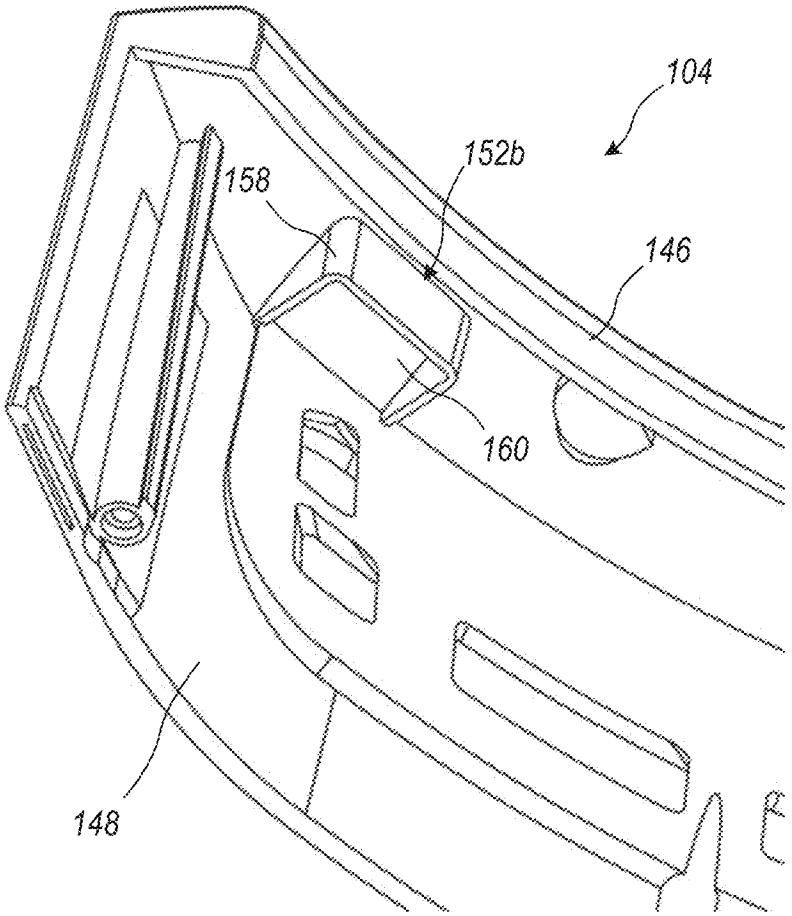
FIG. 7A illustrates a bottom isometric view of a portion of an autonomous cleaning robot, in accordance with at least one example of this disclosure.

FIG. 7A illustrates a bottom isometric view of the bumper 104 of the autonomous cleaning robot 100, in accordance with at least one example of this disclosure. FIG. 7B illustrates a bottom isometric view of the bumper 104 of the autonomous cleaning robot 100, in accordance with at least one example of this disclosure.

The bumper 104 of FIGS. 7A-7C can be consistent with the bumper 104 discussed above with respect to FIGS. 1A-6C; further details are discussed below with respect to FIGS. 7A-7B, For example, FIG. 7A shows that the inner wall 146 can extend downward from the top portion 156 and that the outer wall 148 can extend downward beyond the inner wall 146. FIG. 7A also shows that the hoop wall 158 of the outer hoop 152 can extend downward from the top portion 156 and that the hoop wall 158 can form the hoop cavity 160 together with the top portion 156 and the outer wall 148. Similarly, FIG. 7B shows that the hoop wall 162 of the inner hoop 152 can extend downward from the top portion 156 and that the hoop wall 162 can form the hoop cavity 160 together with the top portion 156 and the outer wall 148.

Figure 8A:
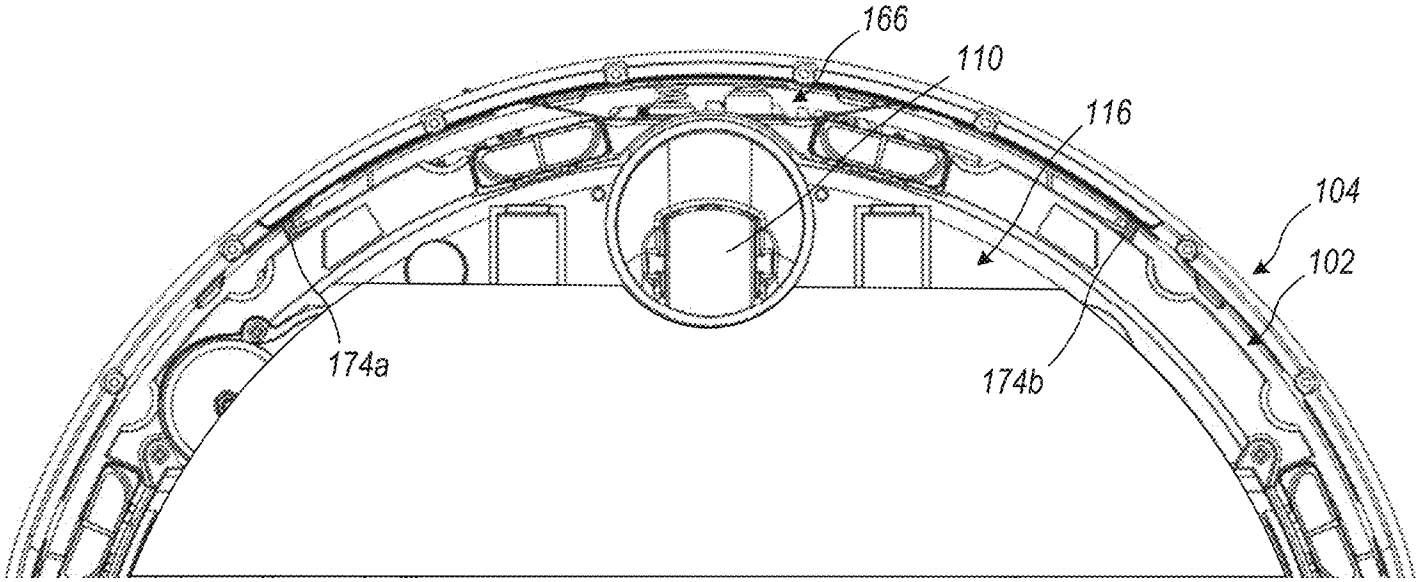
FIG. 8A illustrates a bottom isometric view of a portion of an autonomous cleaning robot, in accordance with at least one example of this disclosure.
Figure 8B:
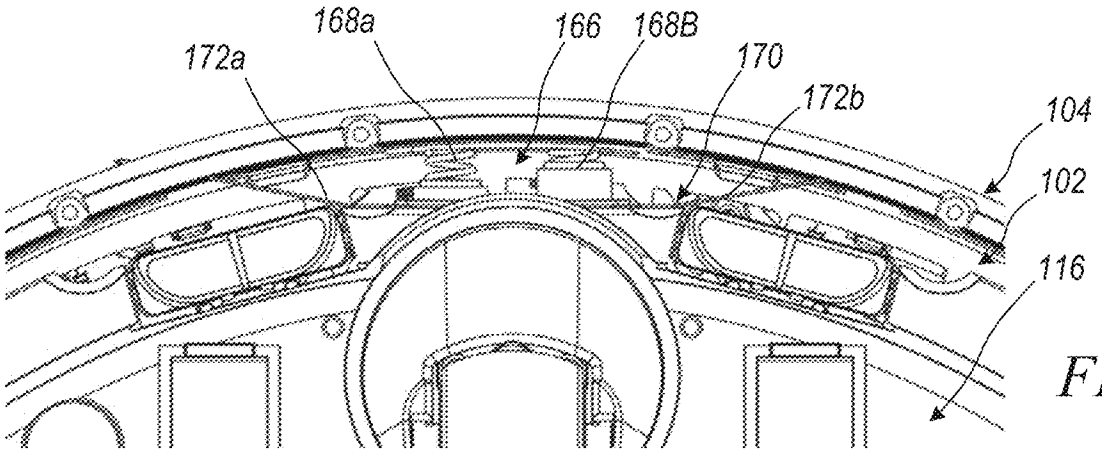
FIG. 8B illustrates a bottom isometric view of a portion of an autonomous cleaning robot, in accordance with at least one example of this disclosure.
Figure 9A:
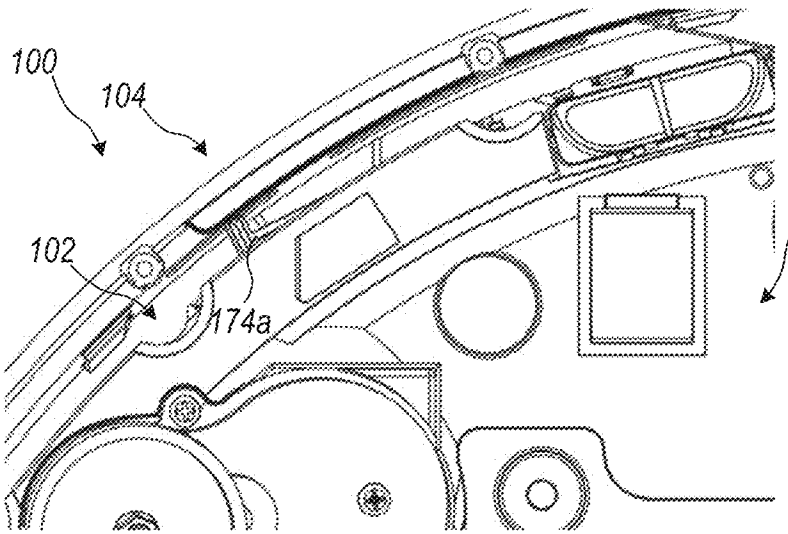
FIG. 9A illustrates a bottom isometric view of a portion of an autonomous cleaning robot, in accordance with at least one example of this disclosure.
Figure 9B:
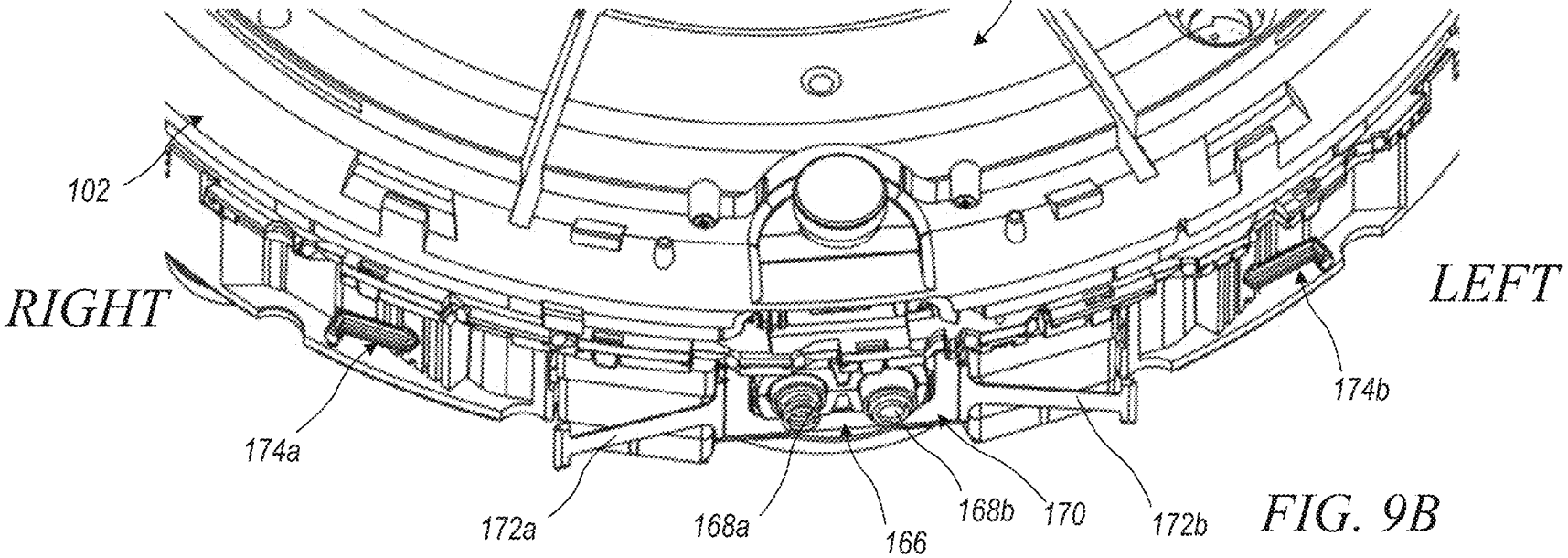
FIG. 9B illustrates a bottom isometric view of a portion of an autonomous cleaning robot, in accordance with at least one example of this disclosure.

FIG. 8A illustrates a bottom isometric view of a portion of the autonomous cleaning robot 100, in accordance with at least one example of this disclosure. FIG. 8B illustrates a bottom isometric view of a portion of the autonomous cleaning robot 100, in accordance with at least one example of this disclosure. FIG. 9A illustrates a bottom isometric view of a portion of the autonomous cleaning robot 100, in accordance with at least one example of this disclosure. FIG. 9B illustrates a bottom isometric view of a portion of the autonomous cleaning robot 100, in accordance with at least one example of this disclosure. FIG. 9B shows orientation indicators Right and Left. FIGS. 8A-9B are discussed below concurrently.

FIG. 8A shows a spring assembly 166 of the robot 102, which can be attached to the body 116 and can engage the bumper 104 to bias the bumper 104 away from the body 116 and the outer shell 102. As shown in FIG. 8B, the spring assembly 166 can include coil springs 168*a* and 168*b* and a flat spring 170. The flat spring 170 can be a relatively long and flat biasing element that includes arms 172*a*, and 172*b*. The flat spring 170 can be comprised of resilient materials, such as spring steel, or the like. The flat spring 170 can be secured to the body 116 and the arms 172*a* and 172*b* can extend outward from the body 116 to contact the bumper 104 to bias the bumper 104 away from the body 116 and the outer shell 102. The coil springs 168*a* and 168*b* can be configured to absorb large impacts to limit force transmission to the robot 100.

Also shown in FIG. 8A are bump switches 174*a* and 174*b* (collectively referred to as bump switches 174), which can each be a push-button switch, rocker switch, toggle switch, or the like. The switches 174 can be configured to independently be engaged and activated by movement of the bumper 104 with respect to the body 116, the outer shell 102, and at least one of the switches 174. In some examples, the bump switches 174 can include a ramp engageable with the bumper 104 to transfer vertical force to a horizontal movement of the switch 174.

As shown in FIG. 9A, the switch 174*a* can extend radially beyond the body 116 to contact the bumper 104 (when the bumper 104 is secured to the outer shell 102 and the body 116) such that radially inward movement of the bumper 104 causes the switch 174*a* to move radially inward with respect to the body 116 to activate. The switch 174*b* can be similarly configured.

As shown in FIG. 9B, the arms 172*a* and 172*b* can be biased to extend away from the body 116 as can the coil springs 168. In this way, the spring assembly 166 can work together to bias the bumper 104 away from the body 116 and the outer shell 102. FIG. 9B also shows that the switches 174*a* and 174*b* can be spaced away from each other, which can allow a bump of the bumper 104 on the right side, for example, to trigger only the right switch 174*a* and a bump on the left side to trigger only the left switch 174*b*. Such an arrangement can help the controller 112 determine a location of the object contacting the bumper 104.

Figure 10A:
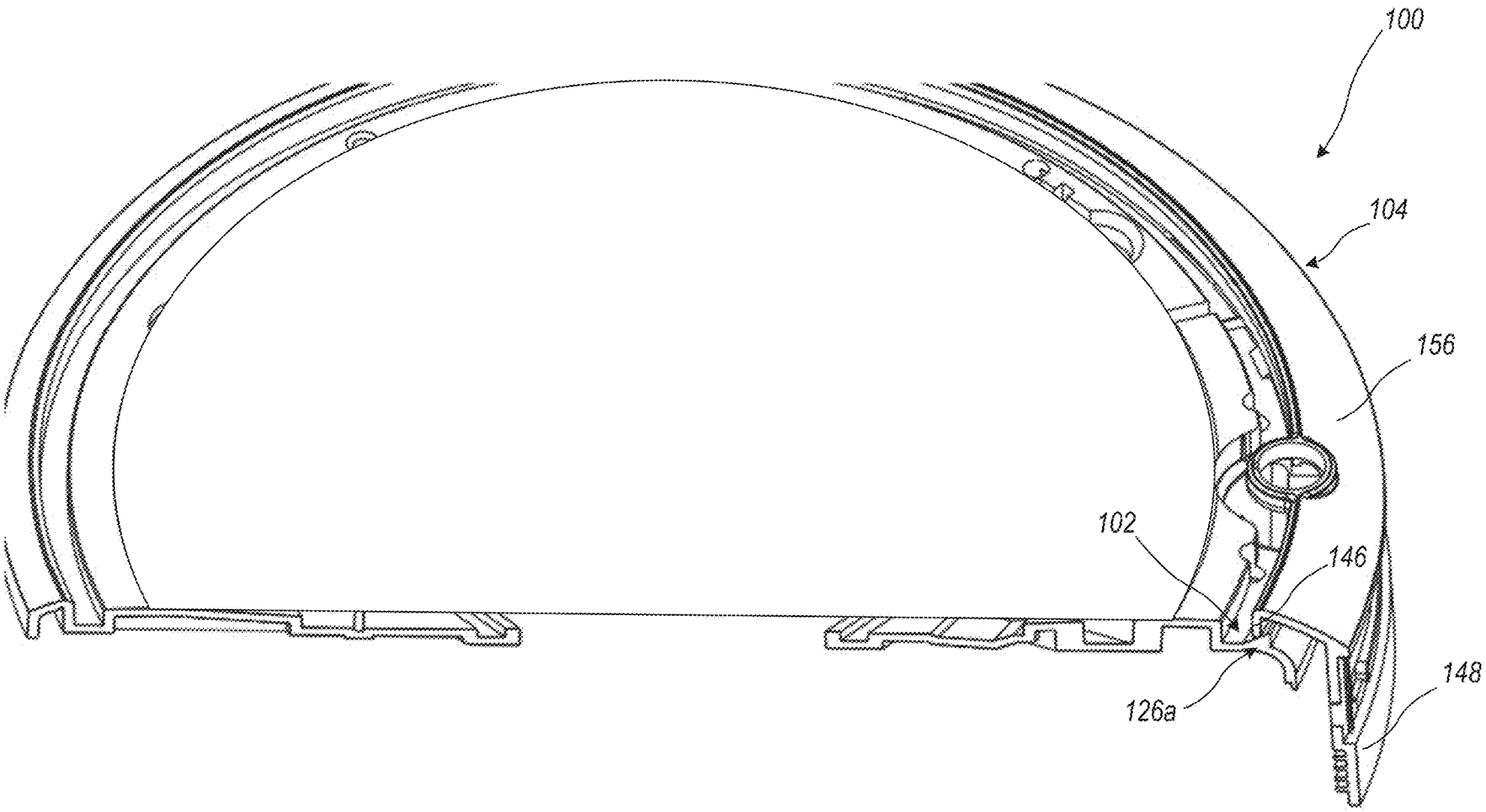
FIG. 10A illustrates a top isometric cross-sectional view of a portion of an autonomous cleaning robot, in accordance with at least one example of this disclosure.
Figure 10B:
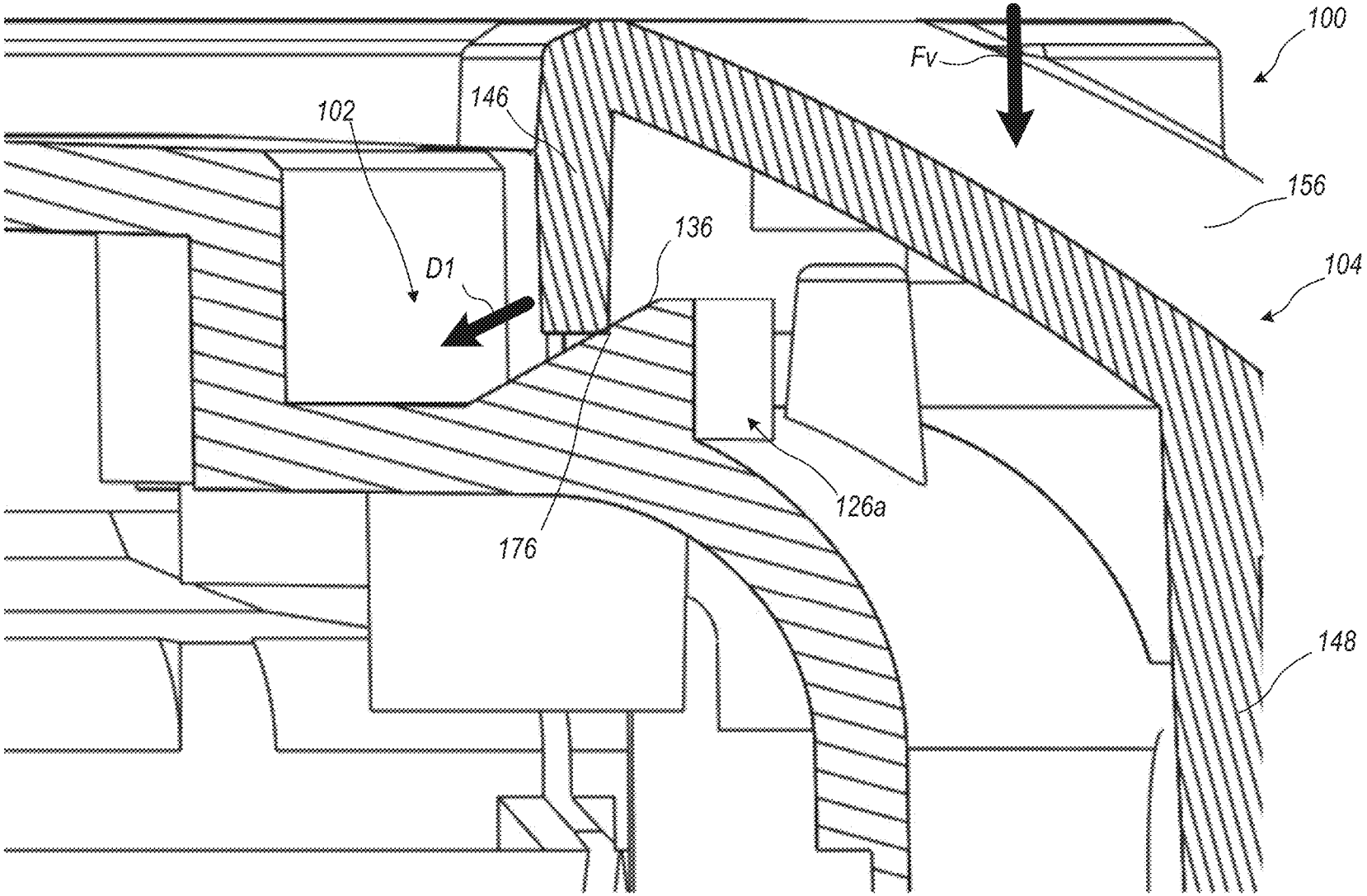
FIG. 10B illustrates a focused top isometric cross-sectional view of a portion of an autonomous cleaning robot, in accordance with at least one example of this disclosure.

FIG. 10A illustrates a top isometric cross-sectional view of a portion of the autonomous cleaning robot 100, in accordance with at least one example of this disclosure. FIG. 10B illustrates a focused top isometric cross-sectional view of the portion of an autonomous cleaning robot 100, in accordance with at least one example of this disclosure. FIGS. 10A and 10B are discussed below concurrently.

The autonomous cleaning robot 100 of FIGS. 10A and 10B can be consistent with the autonomous cleaning robot 100 of FIGS. 1-9B; further details are discussed with respect to FIGS. 10A and 10B. For example, FIG. 10 shows how the inner wall 146 of the bumper 104 can rest on the inner ramp 126*a* when the bumper is in a neutral position (biased away from the outer shell 102).

More specifically, as shown in FIG. 10B, the inner wall 146 can include an edge 176 configured to engage the ramp surface 136 of the ramp 126*a* when the bumper 104 is secured to the outer shell 102 and the body 116. The edge 176 can engage the ramp surface 136 such that when a vertical force Fv is applied to the bumper 104, such as the top portion of the bumper 156, the ramp surface 136 can guide the edge 176, and therefore the inner wall 146 and the bumper 104, to translate in a direction D1 (substantially parallel with the ramp surface 136). The direction D1 can have a horizontal component such that when the force Fv is sufficiently high, the bumper 104 can translate inward and contact one or more of the switches 174*a* and 174*b* to indicate to the controller 112 that a bump has occurred. In this way, the bumper 104 and the outer shell 102 can be configured to work together to translate vertical forces to horizontal movement of the bumper 104 to activate one or more of the switches 174, allowing the controller to detect vertical bumps. This controller 112 can thereby alter operation of the robot 100 to avoid obstacles and can help the robot 100 from becoming wedged (such as under furniture). These features can therefore help the robot 100 avoid mission failures without sensors additional to the horizontal bump switches 174, helping to save manufacturing costs.

Figure 11:
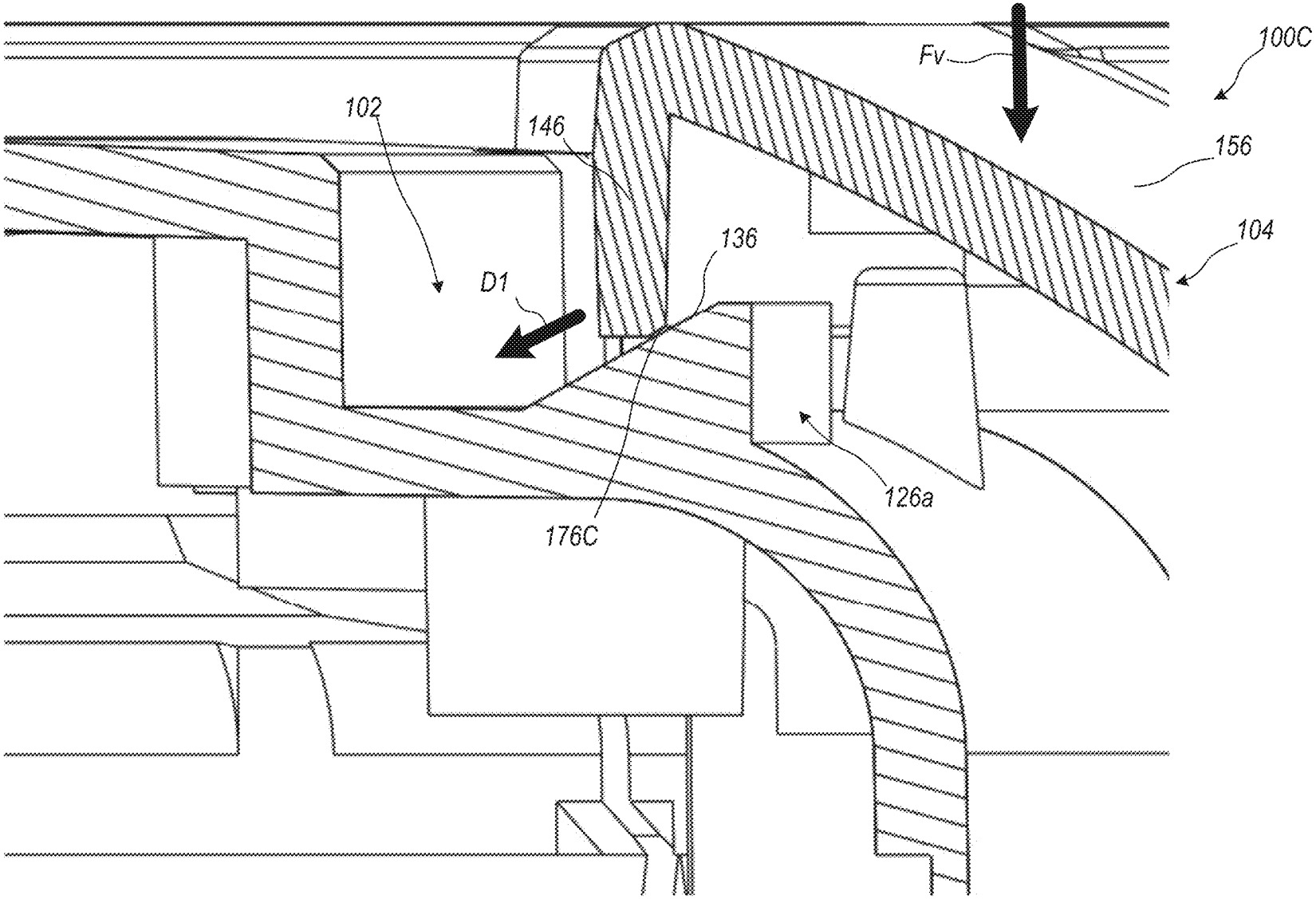
FIG. 11 illustrates a focused top isometric cross-sectional view of a portion of an autonomous cleaning robot, in accordance with at least one example of this disclosure.

FIG. 11 illustrates a focused top isometric cross-sectional view of a portion of an autonomous cleaning robot 1000, in accordance with at least one example of this disclosure. The autonomous cleaning robot 1000 can be similar to the autonomous cleaning robot 100 discussed above, except that the edge 1760 of the inner wall 146 of the bumper 104 can be chamfered such that the edge 176C is substantially parallel to the ramp surface 136 during contact between the edge 176C and the and the ramp surface 136. The chamfered edge 176C can help reduce friction between the edge 176C and the ramp surface 136 and can therefore help reduce wear of the ramp 126*a* and the inner wall 146. Any of the edges or contact surfaces configured to contact ramps discussed herein can be modified to include such a chamfer.

Figure 12A:
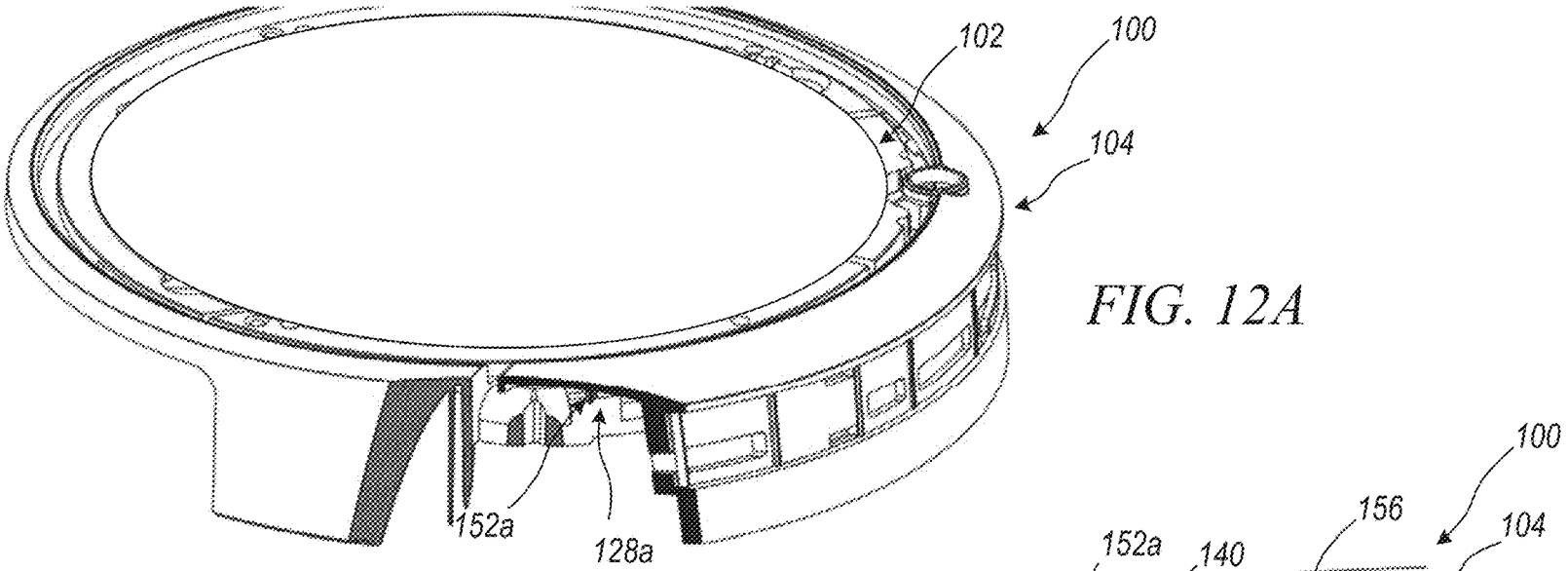
FIG. 12A illustrates a top isometric cross-sectional view of a portion of an autonomous cleaning robot, in accordance with at least one example of this disclosure.
Figure 12B:
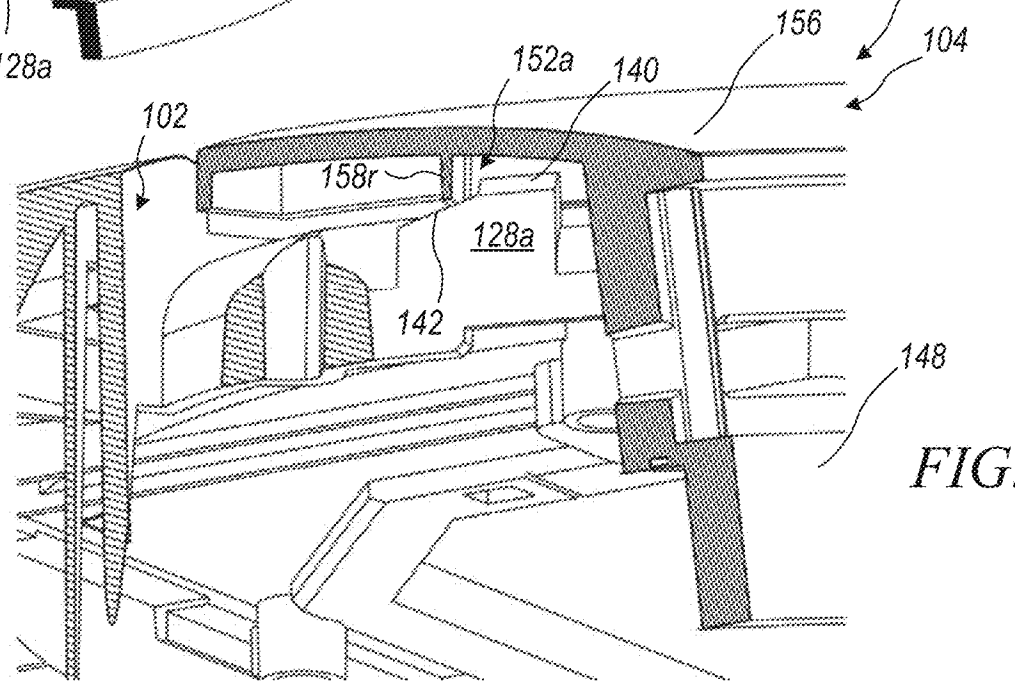
FIG. 12B illustrates a focused top isometric cross-sectional view of a portion of an autonomous cleaning robot, in accordance with at least one example of this disclosure.
Figure 12D:
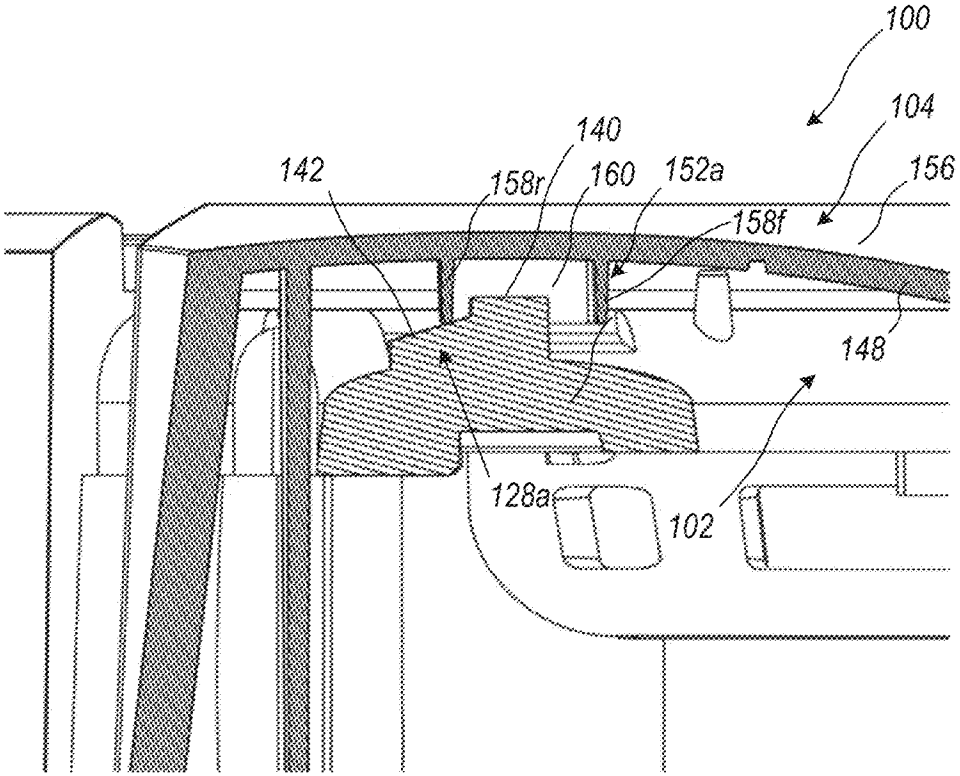
FIG. 12D illustrates a focused isometric cross-sectional view of a portion of an autonomous cleaning robot, in accordance with at least one example of this disclosure.
Figure 12C:
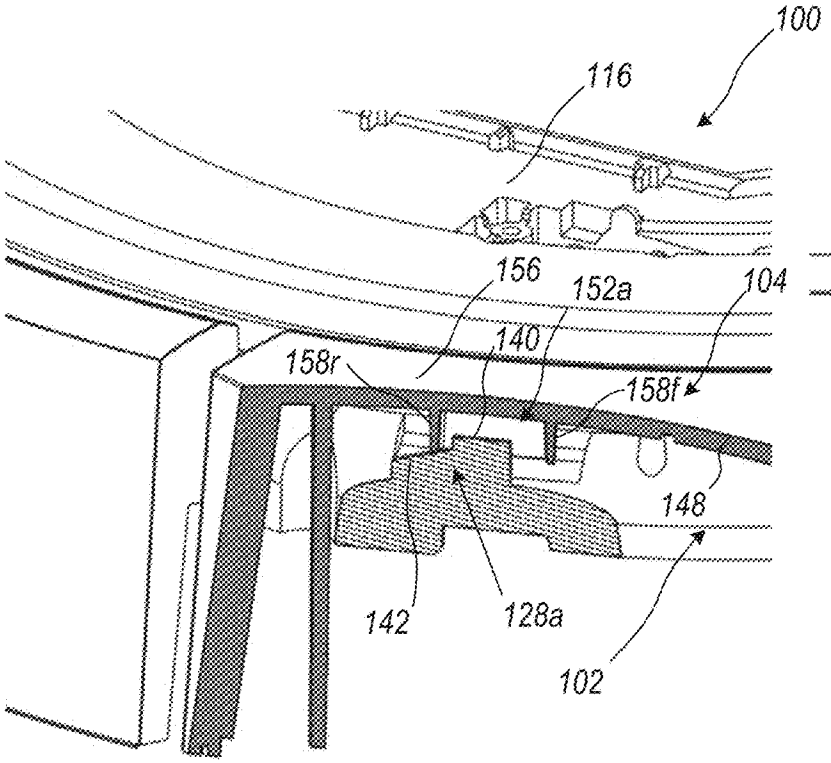
FIG. 12C illustrates a focused top isometric cross-sectional view of a portion of an autonomous cleaning robot, in accordance with at least one example of this disclosure.

FIG. 12A illustrates a top isometric cross-sectional view of a portion of the autonomous cleaning robot 100, in accordance with at least one example of this disclosure. FIG. 12B illustrates a focused top isometric cross-sectional view of a portion of the autonomous cleaning robot 100, in accordance with at least one example of this disclosure. FIG. 12C illustrates a focused top isometric cross-sectional view of a portion of the autonomous cleaning robot 100, in accordance with at least one example of this disclosure. FIG. 12D illustrates a focused isometric cross-sectional view of a portion of the autonomous cleaning robot 100, in accordance with at least one example of this disclosure. FIGS. 12A-12D are discussed below concurrently.

The components of the autonomous mobile cleaning robot 100 can be consistent with FIGS. 1-10B; FIGS. 12A-12D shows additional details of the autonomous cleaning robot 100. For example, FIGS. 12B-12D show that the wall 158 of the rear hoop 152*a* can engage the ramp surface 142 of the rear ramp 128*a* to help the bumper 104 translate toward the outer shell 102 in response to a vertical force applied to the bumper 104.

In some examples, a rear portion of the wall 158*r* can be configured to engage the ramp surface 142 (as shown in FIG. 12B). In other examples, other portions, such as a front portion 158*f*, can be configured to engage the ramp surface 142. In any of these examples, an edge of the wall 158 can be chamfered or rounded at a point of contact with the ramp surface 142 to help reduce friction between the ramp surface 142 and the wall 158 to help reduce wear of these components.

Figure 13B:
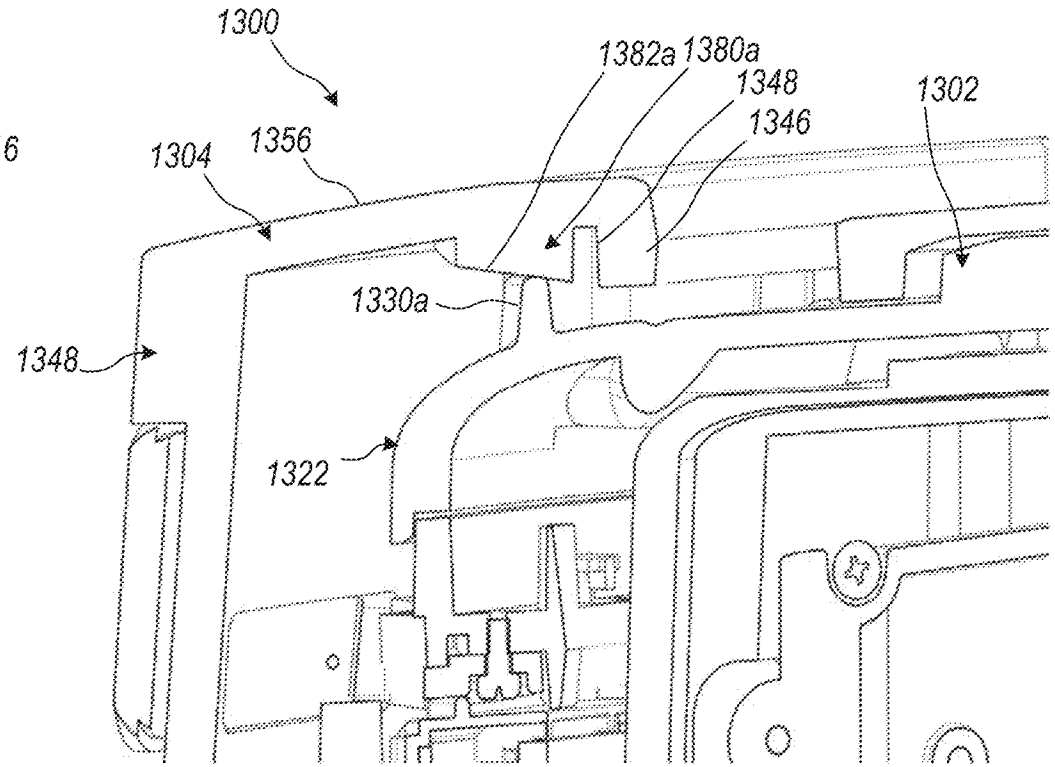
FIG. 13B illustrates a focused top isometric cross-sectional view of a portion of an autonomous cleaning robot, in accordance with at least one example of this disclosure.
Figure 13A:
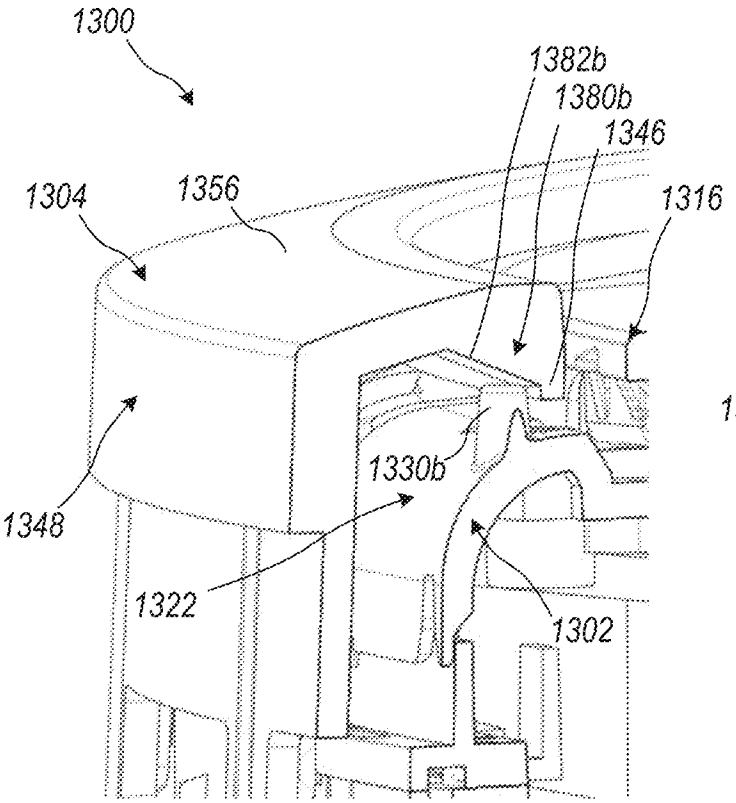
FIG. 13A illustrates a top isometric cross-sectional view of a portion of an autonomous cleaning robot, in accordance with at least one example of this disclosure.
Figure 14A:
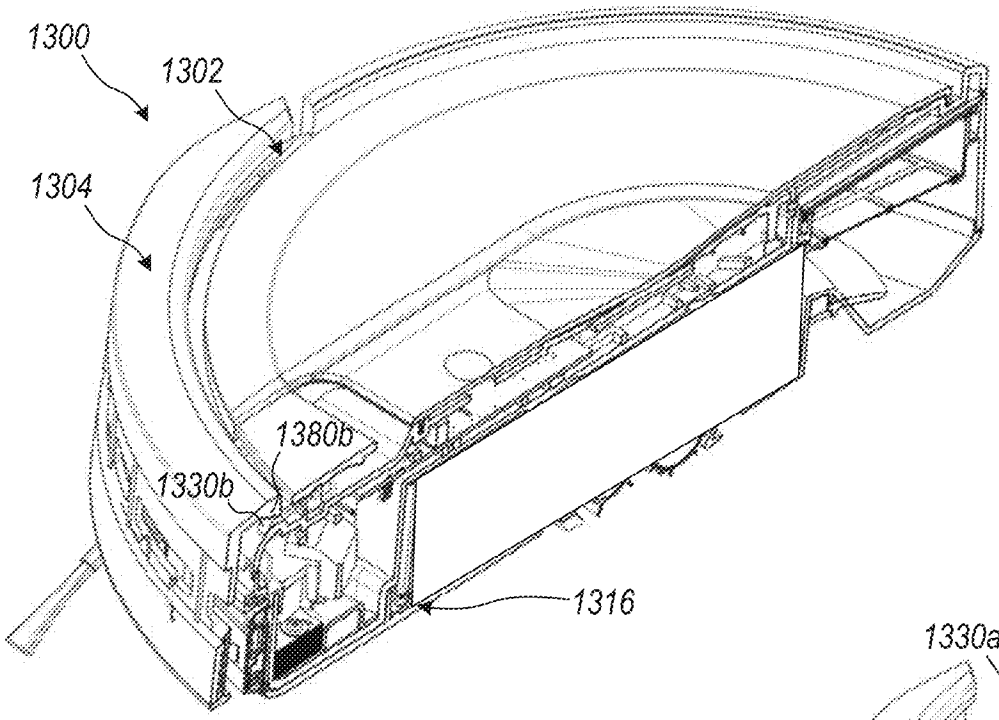
FIG. 14A illustrates a top isometric cross-sectional view of a portion of an autonomous cleaning robot in a first condition, in accordance with at least one example of this disclosure.
Figure 14B:
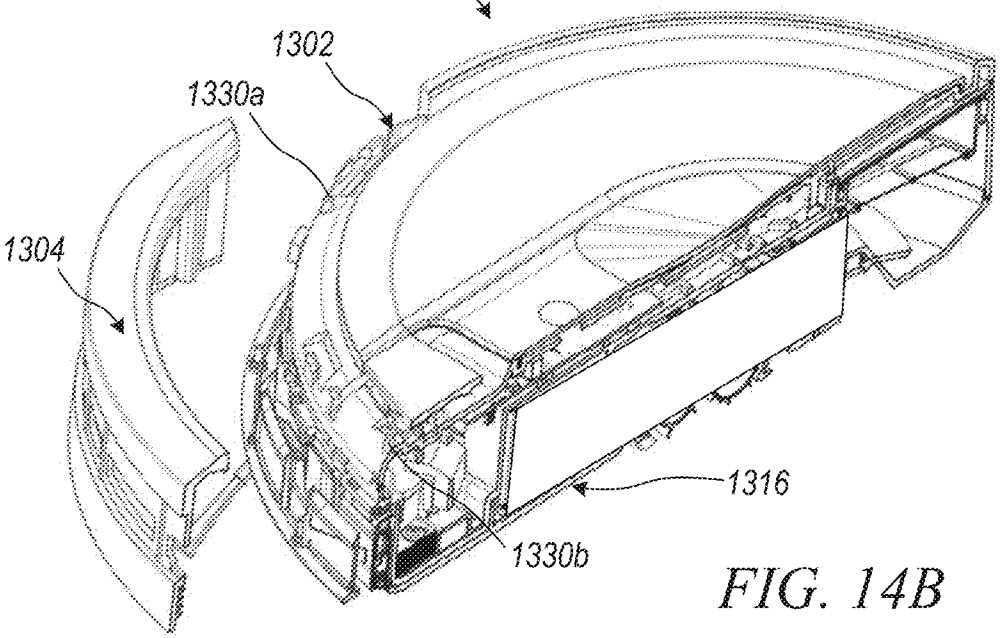
FIG. 14B illustrates a top isometric cross-sectional view of a portion of an autonomous cleaning robot in a second condition, in accordance with at least one example of this disclosure.
Figure 14C:
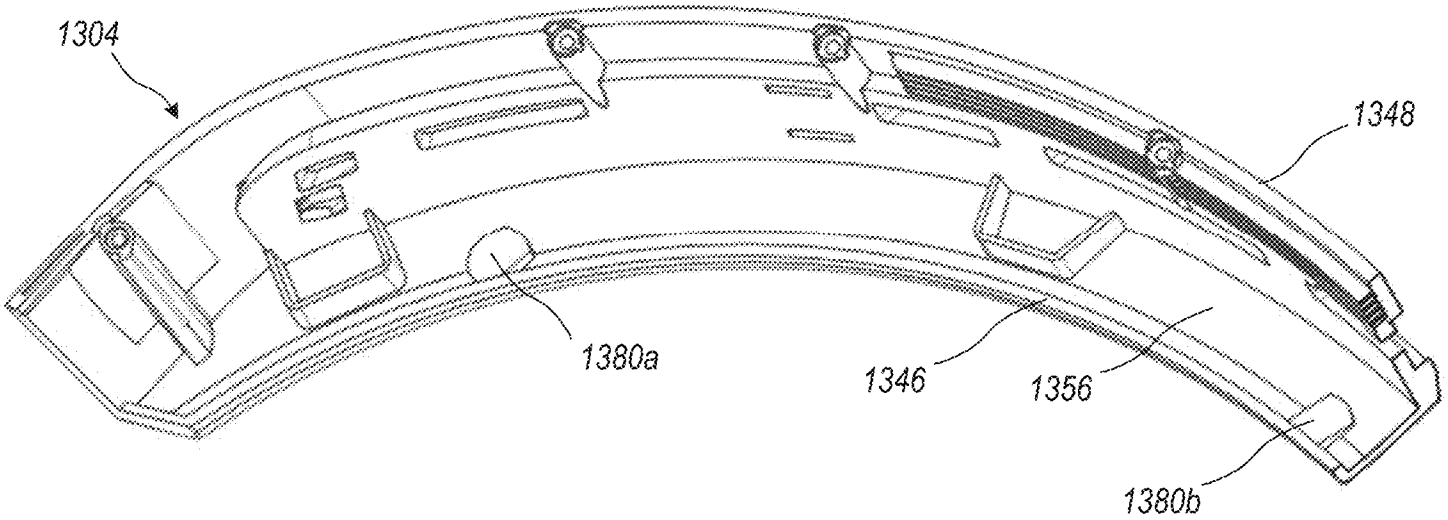
FIG. 14C illustrates a bottom isometric view of a portion of an autonomous cleaning robot, in accordance with at least one example of this disclosure.
Figure 14D:
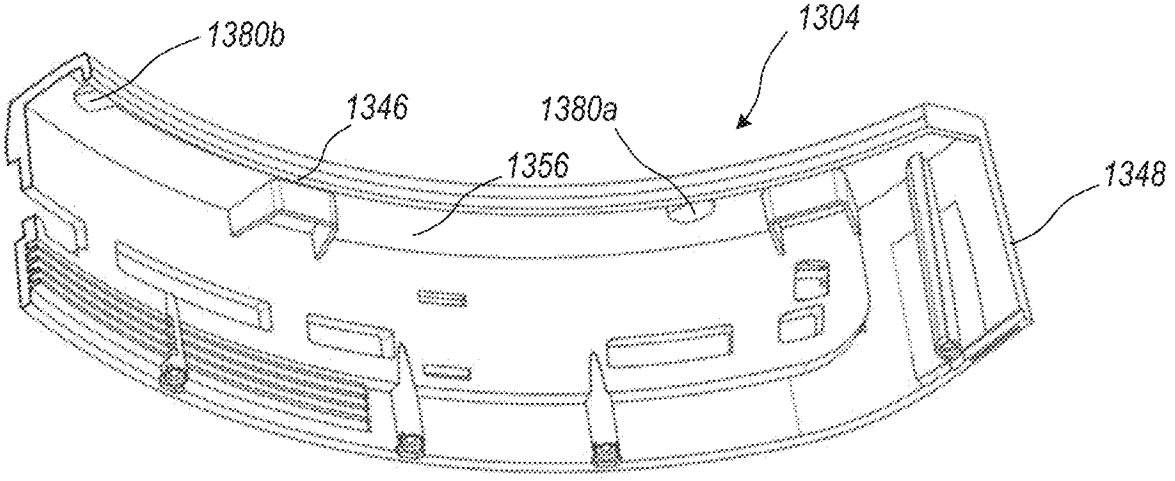
FIG. 14D illustrates a bottom isometric view of a portion of an autonomous cleaning robot, in accordance with at least one example of this disclosure.

FIG. 13A illustrates a top isometric cross-sectional view of a portion of an autonomous mobile cleaning robot 1300, in accordance with at least one example of this disclosure. FIG. 13B illustrates a focused top isometric cross-sectional view of a portion of the autonomous mobile cleaning robot 1300, in accordance with at least one example of this disclosure. FIG. 14A illustrates a top isometric cross-sectional view of a portion of the autonomous mobile cleaning robot 1300 with a bumper 1304 attached, in accordance with at least one example of this disclosure. 14B illustrates a top isometric cross-sectional view of a portion of the autonomous mobile cleaning robot 1300 with the bumper 1304 detached, in accordance with at least one example of this disclosure. FIG. 14C illustrates a bottom isometric view of the bumper 1304 of the autonomous cleaning robot 1300, in accordance with at least one example of this disclosure. FIG. 14D illustrates a bottom isometric view of the bumper 1304 of the autonomous cleaning robot 1300, in accordance with at least one example of this disclosure. FIGS. 13A-14D are discussed below concurrently.

The autonomous mobile cleaning robot 1300 can be similar to those discussed above with respect to FIGS. 1-12D, except that the bumper 1304 can include one or more ramps 1380 each configured to engage a post 1330 to help the bumper 1304 translate toward an outer shell 1302 in response to a vertical force applied to the bumper 1304.

More specifically, the bumper 1380 can include a ramp 1380*b*, as shown in FIGS. 13A and 14B-14D. The ramp 1380*b* can extend from a top portion 1356 of the bumper 1304 downward and inward (toward a center of a body 1316 of the robot 1300). In some examples, the ramp 1380*b* can terminate at an inner wall 1346 of the bumper 1304. The ramp 1380*b* can include a ramp surface 1382*b* that can be configured to engage a post 1330*b* to help the bumper 1304 translate inward with respect to the outer shell 1302 in response to a vertical force applied to the bumper 1304.

Also, as shown in FIGS. 13B and 14C-14D, the bumper 1304 can include a ramp 1380*a*. The ramp 1380*a* can extend from a top portion 1356 of the bumper 1304 downward and inward (toward a center of the body 1316 of the robot 1300). In some examples, the ramp 1380*a* can terminate prior to the inner wall 1346 of the bumper 1304, such that a gap 1384 is located between the ramp 1380*a* and the inner wall 1346. The ramp 1380*a* can include a ramp surface 1382*a* that can be configured to engage a post 1330*a* to help the bumper 1304 translate inward with respect to the outer shell 1302 in response to a vertical force applied to the bumper 1304. In some examples, the ramp surface 1382*a* and a portion of the post 1330*a* can be comprised of relatively low friction materials to help reduce wear of the ramp surface 1382*a* and the post 1330*a*, such as one or more of Polyoxymethylene, Polytetrafluoroethylene, or the like.

NOTES AND EXAMPLES

The following, non-limiting examples, detail certain aspects of the present subject matter to solve the challenges and provide the benefits discussed herein, among others.

Example 1 is an autonomous mobile cleaning robot comprising: an outer shell comprising a first feature connected to the outer shell; and a bumper movably connected to the outer shell, the bumper defining an inner surface, and the bumper comprising: a second feature connected to the inner surface, the second feature engageable with the first feature to cause the bumper to move in a horizontal direction with respect to the outer shell in response to a vertical force applied to the bumper.

In Example 2, the subject matter of Example 1 includes, wherein the first feature of the outer shell includes a ramp angled with respect to a vertical axis of the autonomous mobile cleaning robot.

In Example 3, the subject matter of Example 2 includes, wherein the second feature of the bumper includes a retaining wall configured to retain a pin of the outer shell to together limit horizontal movement of the bumper with respect to the outer shell.

In Example 4, the subject matter of Examples 2-3 includes, wherein the second feature of the bumper includes a radially inner lip of the bumper.

In Example 5, the subject matter of Examples 1-4 includes, wherein the outer shell further comprises a plurality of first features connected to the outer shell, and wherein the bumper further comprises a plurality of second features connected to the inner surface, each second feature of the plurality of second features engageable with one first feature of the plurality of first features to cause the bumper to move in the vertical direction with respect to the outer shell in response to the horizontal force applied to the bumper.

In Example 6, the subject matter of Example 5 includes, wherein at least one of the second features includes a retaining wall configured to retain a pin of the outer shell, and wherein at least another of the second features includes a radially inner lip of the bumper.

In Example 7, the subject matter of Examples 5-6 includes, wherein at least one of the first features includes a ramp angled with respect to a radial axis of the autonomous mobile cleaning robot to, together with one of the second features, cause the bumper to translate radially inward in response to the vertical force applied to the bumper.

In Example 8, the subject matter of Example 7 includes, wherein another of the first features includes a second ramp angled with respect to the radial axis of the autonomous mobile cleaning robot to cause a rear portion of the bumper to translate substantially tangentially with respect to the outer shell in response to the vertical force applied to the bumper.

In Example 9, the subject matter of Example 8 includes, wherein the first ramp and the second ramp are angled in substantially the same direction.

In Example 10, the subject matter of Examples 1-9 includes, a bumper switch activatable by the bumper, the first feature and the second feature configured to cause the bumper to activate the bumper switch in response to the vertical force applied to the bumper.

In Example 11, the subject matter of Examples 1-10 includes, a spring connected to the outer shell and engaged with the bumper to bias the bumper away from the outer shell.

In Example 12, the subject matter of Examples 1-11 includes, wherein the first feature of the outer shell includes a pin.

In Example 13, the subject matter of Example 12 includes, wherein the second feature of the bumper includes a ramp angled with respect to a vertical axis of the autonomous mobile cleaning robot comprising.

In Example 14, the subject matter of Examples 12-13 includes, wherein the at least a portion of the post includes polyoxymethylene.

In Example 15, the subject matter of Examples 12-14 includes, wherein the outer shell further comprises a plurality of first features connected to the outer shell, and wherein the bumper further comprises a plurality of second features connected to the inner surface, each second feature of the plurality of second features engageable with one first feature of the plurality of first features to cause the bumper to move in the horizontal direction with respect to the outer shell in response to the vertical force applied to the bumper.

In Example 16, the subject matter of Example 15 includes, wherein at least one of the second features includes a ramp angled with respect to a radial axis of the autonomous mobile cleaning robot to cause the bumper to translate radially inward.

In Example 17, the subject matter of Example 16 includes, wherein another of the second features includes a second ramp angled with respect to the radial axis of the autonomous mobile cleaning robot to cause the bumper to translate substantially tangentially with respect to the outer shell.

In Example 18, the subject matter of Example 17 includes, wherein the plurality of ramps includes two ramps positioned on a first side of the bumper and includes another two ramps positioned on a second side of the bumper.

Example 19 is an autonomous mobile cleaning robot comprising: an outer shell comprising a first feature extending outward from the outer surface; and a bumper supported by the outer shell and including an inner surface, the bumper movable with respect to the outer shell, the bumper comprising: a second feature extending from to the inner surface, the second feature engageable with the first feature to cause the bumper to move horizontally with respect to the outer shell when a vertical force is applied to the bumper.

In Example 20, the subject matter of Example 19 includes, a spring connected to the bumper and engaged with the bumper to bias the bumper away from the outer shell.

In Example 21, the subject matter of Example 20 includes, a bumper switch activatable by the bumper, the first feature and the second feature configured to cause the bumper to move to activate the bumper switch when the vertical force applied to the bumper is greater than a spring force applied to the bumper by the spring.

In Example 22, the subject matter of Examples 19-21 includes, wherein the first feature is monolithically formed with the outer shell.

In Example 23, the subject matter of Examples 19-22 includes, wherein the second feature is monolithically formed with the bumper.

Example 24 is at least one machine-readable medium including instructions that, when executed by processing circuitry, cause the processing circuitry to perform operations to implement of any of Examples 1-23.

Example 23 is an apparatus comprising means to implement of any of Examples 1-23.

Example 25 is a system to implement of any of Examples 1-23.

Example 26 is a method to implement of any of Examples 1-23.

In Example 27, the apparatuses or method of any one or any combination of Examples 1-26 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:

an outer shell;

a post connected to the outer shell; and a bumper movably connected to the outer shell, the bumper defining an inner surface, and the bumper comprising:

a ramp connected to the inner surface, the ramp angled with respect to a vertical axis of the mobile cleaning robot, and the ramp engageable with the post to cause the bumper to move in a horizontal direction with respect to the outer shell in response to a vertical force applied to a top portion of the bumper.

2. The mobile cleaning robot of claim 1, further comprising:

a plurality of posts connected to the outer shell, the plurality of posts including the post.

3. The mobile cleaning robot of claim 2, wherein the bumper includes a plurality of ramps connected to the inner surface, each ramp of the plurality of ramps engageable with one post of the plurality of posts to cause the bumper to move in the horizontal direction with respect to the outer shell in response to the vertical force applied to the bumper.

4. The mobile cleaning robot of claim 1, wherein the ramp is sloped downward and horizontally inward with respect to the bumper and the outer shell.

5. The mobile cleaning robot of claim 1, wherein the ramp is formed into an inner surface of the bumper.

6. The mobile cleaning robot of claim 1, further comprising:

a spring connected to the outer shell and engaged with the bumper to bias the bumper away from the outer shell.

7. The mobile cleaning robot of claim 1, further comprising:

a bumper switch activatable by the bumper, the post and the ramp configured to cause the bumper to activate the bumper switch in response to the vertical force applied to the bumper.

8. A mobile cleaning robot comprising:

an outer shell;

a first ramp connected to the outer shell; and a bumper movably connected to the outer shell, the bumper defining an inner surface, and the bumper comprising:

a second ramp connected to the inner surface, the second ramp angled with respect to a vertical axis of the mobile cleaning robot, and the second ramp engageable with the first ramp to cause the bumper to move in a horizontal direction with respect to the outer shell in response to a vertical force applied to a top portion of the bumper.

9. The mobile cleaning robot of claim 8, further comprising:

a plurality of first ramps connected to the outer shell, the plurality of first ramps including the first ramp.

10. The mobile cleaning robot of claim 9, wherein the bumper includes a plurality of second ramps connected to the inner surface, each second ramp of the plurality of second ramps engageable with one first ramp of the plurality of first ramps to cause the bumper to move in the horizontal direction with respect to the outer shell in response to the vertical force applied to the bumper.

11. The mobile cleaning robot of claim 8, wherein the second ramp is sloped downward with respect to the bumper and inward toward the outer shell.

12. The mobile cleaning robot of claim 8, wherein the second ramp is formed into an inner surface of the bumper.

13. The mobile cleaning robot of claim 8, further comprising:

a spring connected to the outer shell and engaged with the bumper to bias the bumper away from the outer shell; and a bumper switch activatable by the bumper, the first ramp and the second ramp configured to cause the bumper to activate the bumper switch in response to the vertical force applied to the bumper.

14. An mobile cleaning robot comprising:

an outer shell including a ramp connected thereto; and a bumper movably connected to the outer shell, the bumper comprising:

an inner lip engageable with the ramp to cause the bumper to move in a horizontal direction with respect to the outer shell in response to a vertical force applied to a top portion of the bumper.

15. The mobile cleaning robot of claim 14, wherein the outer shell includes a plurality of ramps connected to the outer shell, the inner lip of the bumper engageable with each ramp of the plurality of ramps to cause the bumper to move in the horizontal direction with respect to the outer shell in response to the vertical force applied to the bumper.

16. The mobile cleaning robot of claim 14, wherein the inner lip includes a chamfered surface configured to contact the ramp.

17. The mobile cleaning robot of claim 14, wherein the ramp is a first ramp and the outer shell includes a second ramp and the bumper includes a skid feature engageable with the second ramp to cause a rear portion of the bumper to translate substantially tangentially with respect to the outer shell in response to the vertical force applied to the bumper.

18. The mobile cleaning robot of claim 17, wherein the feature of the bumper includes a retaining wall configured to retain a post of the outer shell such that the post together with the wall limits horizontal movement of the bumper with respect to the outer shell.

19. The mobile cleaning robot of claim 17, wherein the first ramp and the second ramp are angled in substantially the same direction.

20. The mobile cleaning robot of claim 14, further comprising:

a bumper switch activatable by the bumper, the ramp and the inner lip configured to cause the bumper to activate the bumper switch in response to the vertical force applied to the bumper; and a spring connected to the outer shell and engaged with the bumper to bias the bumper away from the outer shell.

* * * * *